US009283801B2

(12) United States Patent
Tani

(10) Patent No.: US 9,283,801 B2
(45) Date of Patent: Mar. 15, 2016

(54) METHOD FOR MANUFACTURING A COATING INSTRUMENT

(71) Applicant: Tokiwa Corporation, Gifu (JP)

(72) Inventor: Yoshikazu Tani, Saitama (JP)

(73) Assignee: Tokiwa Corporation, Gifu (JP)

( * ) Notice: Subject to any disclaimer, the term of this patent is extended or adjusted under 35 U.S.C. 154(b) by 223 days.

(21) Appl. No.: 14/181,357

(22) Filed: Feb. 14, 2014

(65) Prior Publication Data

US 2015/0231916 A1 Aug. 20, 2015

(51) Int. Cl.

| | |
|---|---|
| ***B65D 83/00*** | (2006.01) |
| ***A45D 34/04*** | (2006.01) |
| ***B43K 15/00*** | (2006.01) |
| ***B43K 11/00*** | (2006.01) |

(52) U.S. Cl.

CPC ..... *B43K 15/00* (2013.01); *B43K 11/00* (2013.01); *A45D 2200/055* (2013.01); *B65D 83/0005* (2013.01); *Y10T 29/49401* (2015.01)

(58) Field of Classification Search

CPC . B65D 83/005; A45D 34/04; A45D 2200/055

USPC ..... 401/150, 171–182

See application file for complete search history.

(56) References Cited

U.S. PATENT DOCUMENTS

| | | | | |
|---|---|---|---|---|
| 7,677,828 | B2 * | 3/2010 | Tani | A45D 40/04 401/172 |
| 2003/0057236 | A1 * | 3/2003 | Delage | A45D 40/26 222/390 |
| 2013/0279965 | A1 * | 10/2013 | Tani | B65D 83/0005 401/172 |

FOREIGN PATENT DOCUMENTS

JP 2006136774 A 6/2006

OTHER PUBLICATIONS

Patent Abstracts of Japan, Publication No. JP2006-136774 dated Jan. 6, 2006 (1 page).

* cited by examiner

*Primary Examiner* — David Walczak
*Assistant Examiner* — Joshua Wiljanen
(74) *Attorney, Agent, or Firm* — Osha Liang LLP

(57) ABSTRACT

There is provided a method for manufacturing a coating instrument provided with a filling member having a filling region in which a coating material is filled and a body portion including an extruding portion inserted inside so as to be brought into close contact with the filling member and constituting a rear end of the filling region, in which the coating material is discharged from a discharge outlet on a tip end side of the filling member by advance of the extruding portion, including a step of filling the coating material into the filling region of the filling member from behind in a state in which a front side of the filling member is located below the rear side, a step of feeding a predetermined amount of air from the discharge outlet into the filling region so that a space is formed on the tip end side in the filling region after the coating material is filled, and a step of assembling the body portion to the filling member after the air is fed.

8 Claims, 18 Drawing Sheets

METHOD FOR MANUFACTURING A COATING INSTRUMENT

BACKGROUND OF THE INVENTION

1. Field of the Invention

An aspect of the present invention relates to a method for manufacturing a coating instrument used by extruding a coating material.

2. Related Background Art

As a prior-art method for manufacturing a coating instrument, a method described in Japanese Patent Laid-Open No. 2006-136774, for example, is known. In the manufacturing method described in Japanese Patent Laid-Open No. 2006-136774, when a coating portion is elastically recovered after a coating filler (coating material) is filled in a filling region in a state in which the coating portion of a filling member is recessed, a space is formed on a tip end side including a discharge outlet in the filling region. As a result, even if the coating material is swollen or the like due to a temperature change or an air pressure change, leakage of the coating material from the discharge outlet can be prevented.

SUMMARY OF THE INVENTION

Here, in the above described method for manufacturing a coating instrument, as described above, since the space is formed on the tip end side in the filling region by the elastic recovery of the coating portion, the space cannot be sufficiently formed in some cases depending on a shape of the coating portion, for example. Thus, in the recent methods for manufacturing a coating instrument, securing of a space of a certain amount on the tip end side in the filling region so as to reliably prevent leakage of the coating material from the discharge outlet is in demand.

Thus, the one aspect of the present invention has an object to provide a method for manufacturing a coating instrument which can reliably prevent leakage of the coating material from the discharge outlet.

In order to solve the above described problem, the method for manufacturing a coating instrument according to the one aspect of the present invention is a method for manufacturing a coating instrument provided with a filling member having a filling region in which a coating material is filled and a body portion including an extruding portion inserted inside so as to be brought into close contact with the filling member and constituting a rear end of the filling region, in which the coating material is discharged from a discharge outlet on a tip end side of the filling member by advance of the extruding portion, the method including a step of filling the coating material into the filling region of the filling member from a rear side in a state in which a front side of the filling member is located below the rear side, a step of feeding a predetermined amount of air from the discharge outlet into the filling region so that a space is formed on the tip end side in the filling region after the coating material is filled, and a step of assembling the body portion to the filling member after the air is fed.

In the method for manufacturing according to the one aspect of the present invention, after the air is fed from the discharge outlet into the filling region in which the coating material is filled, the body portion is assembled to the filling member. As a result, a certain amount of space can be reliably ensured on the tip end side in the filling region, and leakage of the coating material from the discharge outlet can be reliably prevented by this certain amount of space.

In the step of feeding the air, by reducing a volume of an airtight space in a periphery of the coating instrument in a state in which the discharge outlet is located in the airtight space, the air may be fed into the filling region. In this case, the above described step of feeding the air from the discharge outlet into the filling region can be specifically realized.

The discharge outlet or the tip end side of the filling region may have a predetermined diameter such that the coating material filled in the filling region in a molten state does not flow down from the discharge outlet. In this case, the coating material can be reliably filled in the filling region. Moreover, since the coating material does not flow down from the discharge outlet, the air can be effectively fed from the discharge outlet.

The filling member may be provided with a channel portion extending so as to lead to an outside of the filling member in the coating instrument from the filling region, and in the step of assembling the body portion, a part of the coating material may be allowed to flow out to the outside of the filling region through the channel portion. In this case, interposition of the air between the coating material and the extruding portion can be suppressed.

DESCRIPTION OF THE PREFERRED EMBODIMENTS

Figure 1:
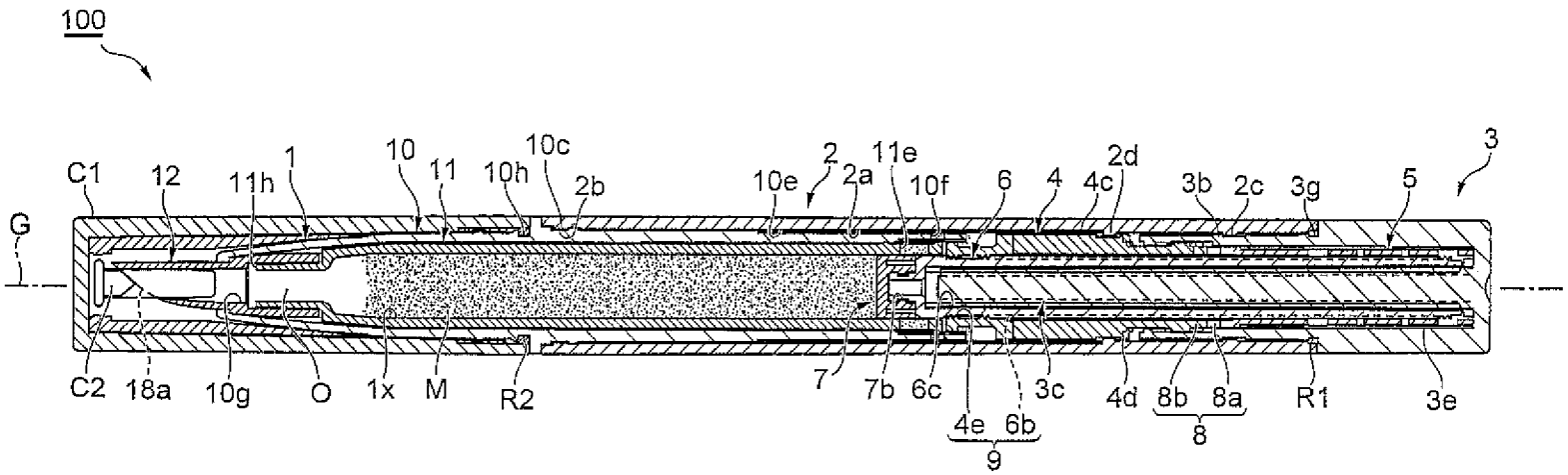
FIG. 1 is a longitudinal sectional view illustrating an initial state of a coating instrument according to an embodiment.

Hereinafter, an embodiment according to an aspect of the present invention will be described in detail by referring to the attached drawings. In the following explanation, the same reference numerals are given to the same or corresponding elements, and duplicated explanation will be omitted.

Figure 2:
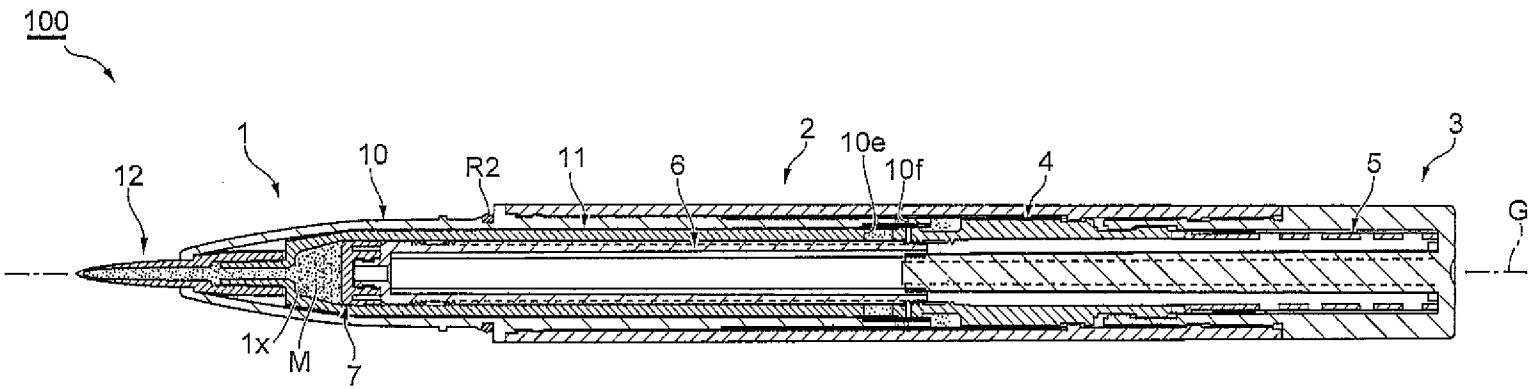
FIG. 2 is a longitudinal sectional view having a longitudinal sectional position in FIG. 1 at a position different by 90° illustrating a state of an advance limit of a moving body in the coating instrument in FIG. 1.
Figure 3:
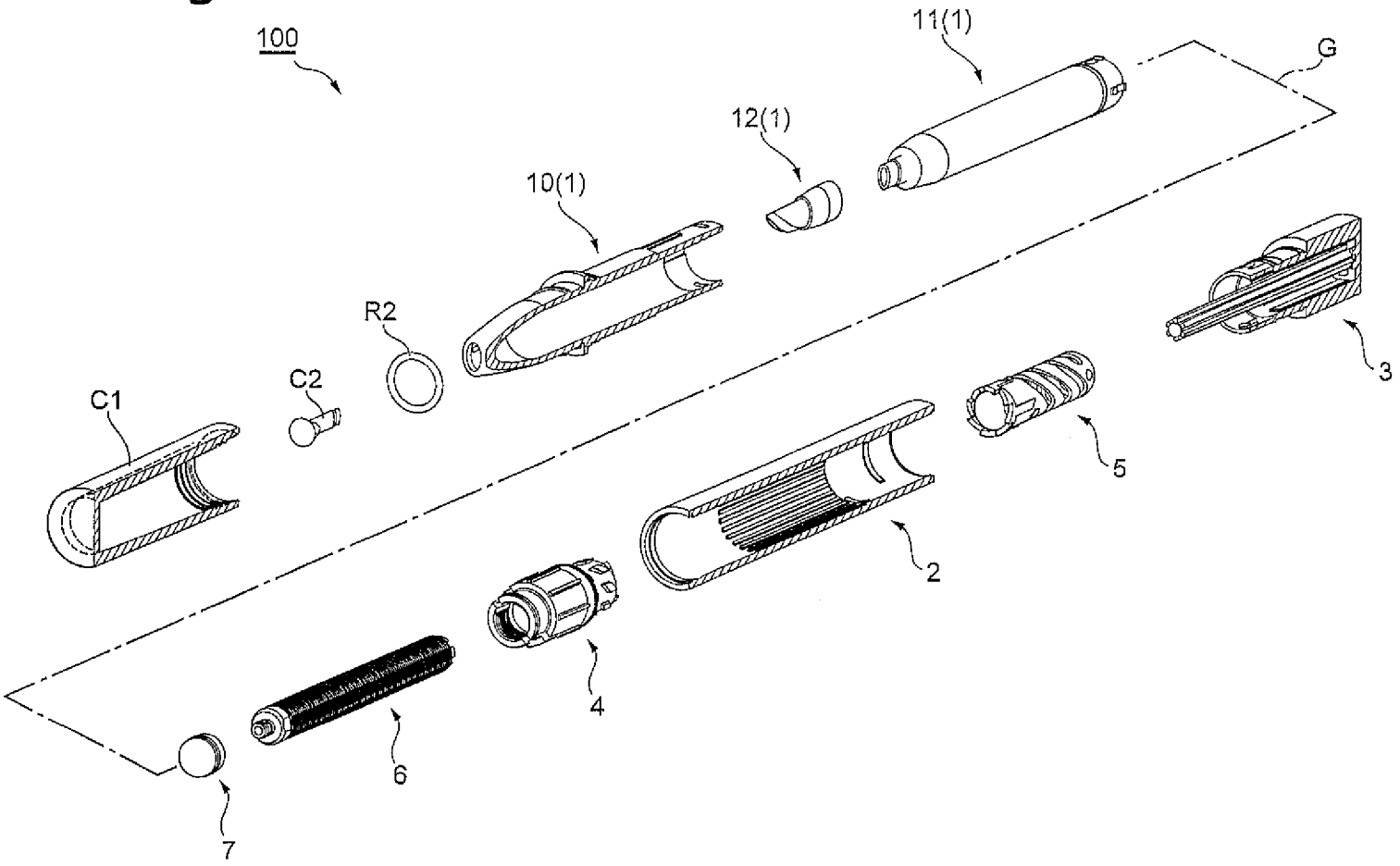
FIG. 3 is an exploded perspective view illustrating the coating instrument in FIG. 1 in a partially sectional view.
Figure 4:
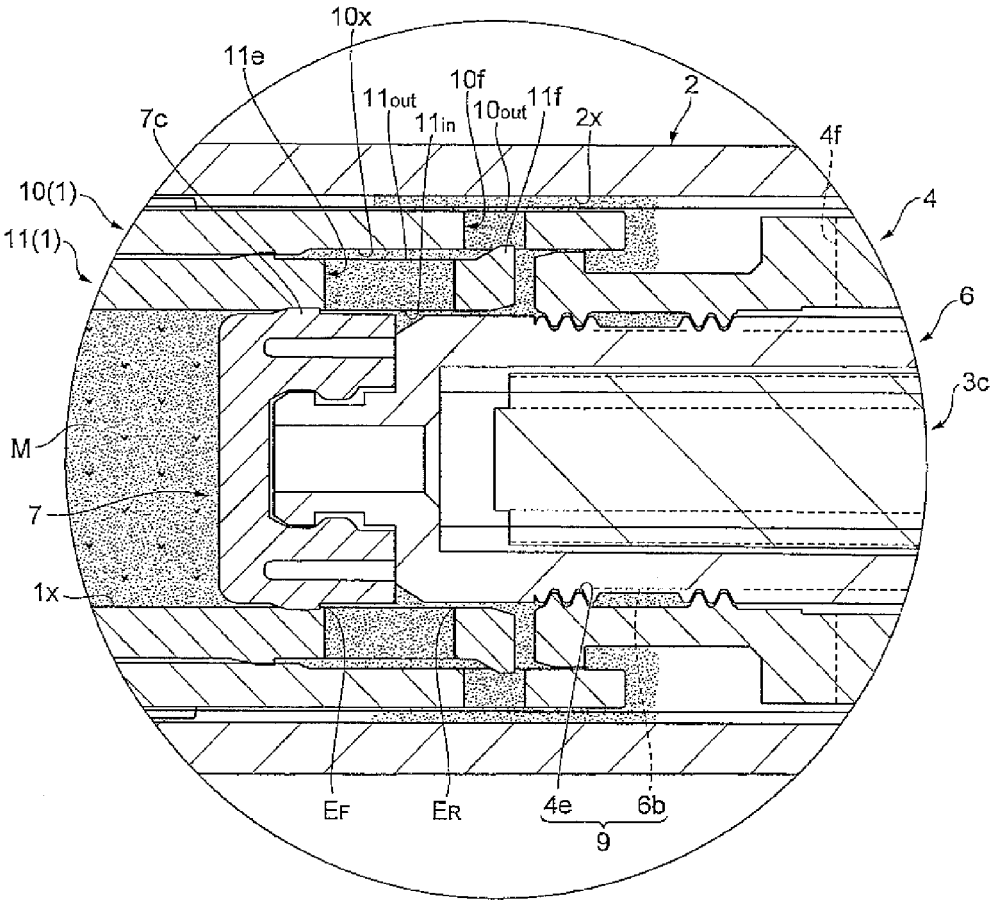
FIG. 4 is a sectional view illustrating an essential part in the coating instrument in FIG. 1 in an enlarged manner.

FIG. 1 is a longitudinal sectional side view illustrating an initial state of a coating instrument according to an embodiment, FIG. 2 is a longitudinal sectional side view illustrating a state of an advance limit of a moving body in the coating instrument, FIG. 3 is an exploded perspective view illustrating the coating instrument in a partially sectional view, and FIG. 4 is a sectional view illustrating an essential part in the coating instrument in FIG. 1 in an enlarged manner. FIG. 2 is a longitudinal sectional view having a longitudinal sectional position in FIG. 1 at a position different by 90°. As illustrated in FIGS. 1 to 3, a coating instrument 100 of this embodiment is to discharge (extrude) a coating material M filled therein as appropriate by an operation of a user.

As the coating material M, for example, various liquid, jelly-like, gel, paste, soft, mousse-like, kneaded, muddy, semisolid, soft solid, solid substances and the like including eye liners, eye colors, eye shadows, eyebrows, lip glosses, lips, lip liners, cheek colors, beauty liquids, beauty sticks, cleansing liquids, cleansing oils, nail enamels, nail care solutions, nail removers, mascaras, anti-aging agents, hair colors, application products for scalp, oral care products, massage oils, blackhead removing liquids, foundations, concealers, skin creams, inks for writing utensils, pharmaceuticals and the like can be used. Moreover, by mixing volatile solvents (silicone oils such as cyclopentasiloxane and the like and hydrocarbon oils such as isododecane, isohexadecane and the like, for example) with the coating material M in addition to pigments, ointments, waxes and the like, its retaining performance can be improved. As an example of the coating material M, a makeup cosmetic such as a gel eyeliner and the like mixed with a volatile component (volatile solvent) with improved long lasting performance, for example, can be used.

Moreover, as the coating material M, a gel or a semisolid material with high viscosity or hardness and high compressibility can be used. Particularly, as the coating material M, the coating material M having hardness of approximately 0.1 to 0.3 N can be used. The hardness of the coating material M is acquired by a general measuring method used for measuring hardness in cosmetics. Here, by using FUDOH RHEO METER [RTC-2002D.D] (by Rheotech Co., Ltd.) as a measuring instrument, a force (strength) at a peak generated in the coating material M when a steel bar (adapter) having ϕ3 mm is inserted by a depth of approximately 10 mm into the coating material M at a speed of 6 cm/min under a condition of an atmospheric temperature of 25° C. is regarded as hardness (penetration), for example.

This coating instrument 100 is provided with a filling member 1 which is a tip cylinder provided with a filling region 1*x* in which the coating material M is filled therein, a body cylinder 2 having its front half portion into which a rear half portion of the filling member 1 is inserted and engaging and connecting the filling member 1 in an axial direction (longitudinal direction) and a rotating direction around an axis (hereinafter also referred to simply as a "rotating direction") so as to be integrated, and an operation cylinder 3 connected in the axial direction to a rear end portion of this body cylinder 2 capable of relative rotation as an outer shape configuration. The filling member 1 and the body cylinder 2 constitute a front part of a container, and the operation cylinder 3 constitutes a rear part of the container. Moreover, the "axis" means a center line G extending longitudinally in the coating instrument 100, and the "axial direction" means a direction along the axis (the same applies to the following). Moreover, here, a feeding-out direction of the coating material M on a pen point member 12 side which will be described later in the axial direction is assumed to be the front (an advancing direction), and a feeding-back direction of the coating material M on the operation cylinder 3 side in the axial direction is assumed to be the rear (a retreating direction).

This coating instrument 100 is roughly provided with a moving body 6 moving in the axial direction by relative rotation of the body cylinder 2 (it may be the filling member 1) and the operation cylinder 3, a piston 7 attached at a front end (tip end) portion of the moving body 6 and inserted inside so as to be in close contact with the filling member 1 and constituting (forming) a rear end of the filling region 1*x* as an extruding portion, a screw cylinder 4 as a screwing member enabling movement of the moving body 6 by the relative rotation, and a ratchet member 5 capable of relative rotation only in one direction with respect to the screw cylinder 4.

Moreover, this coating instrument 100 is provided with a ratchet mechanism 8 allowing the relative rotation of the body cylinder 2 and the operation cylinder 3 only in one direction and a cam mechanism 20 advancing/retreating (advancing and retreating) the moving body 6 and the piston 7 within a certain stroke at each relative rotation of the body cylinder 2 and the operation cylinder 3 with a certain rotation amount. Here, this cam mechanism 20 is a cylindrical cam mechanism including a projecting portion 20*a* and a guide portion 20*b*. The cam mechanism 20 advances/retreats the moving body 6 and the piston 7 within a certain stroke by a rotating force of the relative rotation of the body cylinder 2 and the operation cylinder 3.

The body cylinder 2 is formed having a cylindrical shape. The body cylinder 2 has a knurl 2*a* engaging the filling member 1 and the screw cylinder 4 in the rotating direction on an inner peripheral surface at a center part in its axial direction. In the knurl 2*a*, a large number of projections and recesses are juxtaposed in the circumferential direction, and the projections and recesses extend for a predetermined length in the axial direction. On the inner peripheral surface of the tip end portion in the body cylinder 2, an annular projecting portion 2*b* for engaging the filling member 1 in the axial direction is provided. On the inner peripheral surface on the rear part side of the body cylinder 2, a projecting portion 2*c* engaging the operation cylinder 3 in the axial direction is formed. The projecting portion 2*c* extends along the circumferential direction.

On the inner peripheral surface of the body cylinder 2, on the front side of the projecting portion 2*c*, a projecting portion 2*d* engaging the screw cylinder 4 in the axial direction is formed. The projecting portion 2*d* extends along the circumferential direction. As illustrated in FIG. 4, the inner peripheral surface of the body cylinder 2 constitutes a wall portion (second wall portion) 2*x*. The wall portion 2*x* covers an opening $\mathbf{10}_{out}$ on a side (outside the filling region 1*x*) opposite to the filling region 1*x* side in a hole portion 10*f* of an outside filling cylinder 10 which will be described later with a gap.

The wall portion 2*x* has a function of guiding a part of the coating material M flowing out from the hole portion 10*f* rearward.

Figure 5:
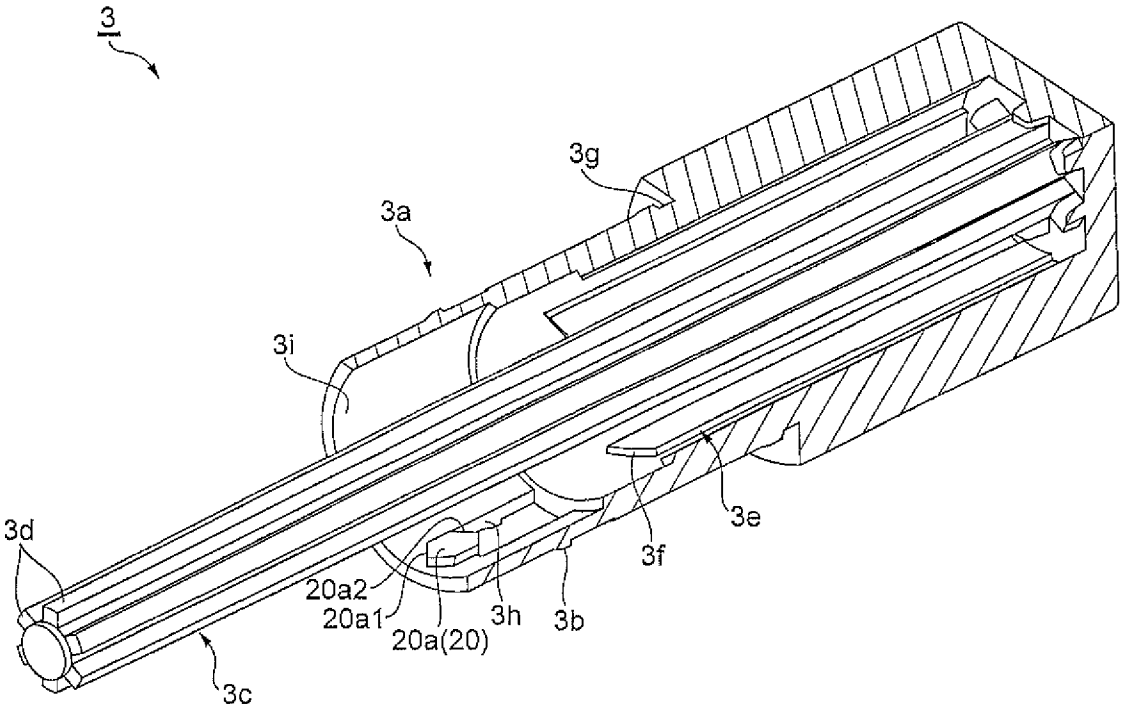
FIG. 5 is a perspective view illustrating an operation cylinder of the coating instrument in FIG. 1 in a partially sectional view.
Figure 6:
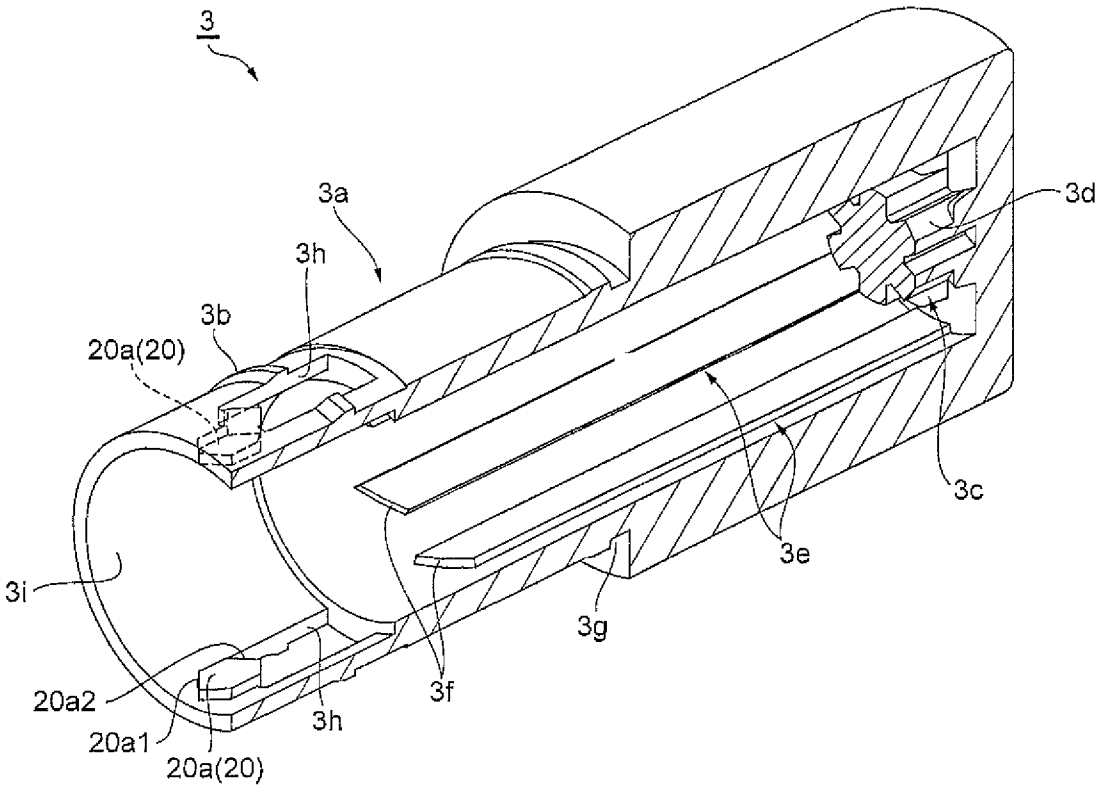
FIG. 6 is another perspective view illustrating the operation cylinder of the coating instrument in FIG. 1 in a partially sectional view.

FIGS. 5 and 6 are perspective views illustrating a part of the operation cylinder in partially sectional views. As illustrated in FIGS. 5 and 6, the operation cylinder 3 is an injection molding of a resin. The operation cylinder 3 presents a cylindrical shape with a bottom opened to the front. The operation cylinder 3 is provided with a front end cylinder portion 3*a* having a small outer diameter on its front end side. On an outer peripheral surface of the front end cylinder portion 3*a*, an annular groove portion 3*b* engaged with the projecting portion 2*c* of the body cylinder 2 is provided in the axial direction. At a center on a bottom portion of the operation cylinder 3, a shaft body 3*c* is installed upright. The shaft body 3*c* has a non-circular cross sectional (cross section orthogonal to the axial direction) shape having a plurality of projections 3*d* extending in the axial direction on the outer peripheral surface of a columnar body. The projections 3*d* constitute one of a retaining portion of the moving body 6.

Moreover, the operation cylinder 3 is provided with projections 3*e* extending from the bottom portion to the tip end side on its inner peripheral surface at positions each in equally distributed into eight parts in the circumferential direction. A tip end surface 3*f* of the projection 3*e* is inclined with respect to a cross sectional surface which is an orthogonal surface in the axial direction (hereinafter referred to simply as a "cross sectional surface"). Specifically, the tip end surface 3*f* is inclined rearward as it goes toward one side in the circumferential direction on a radial direction view. In other words, the tip end surface 3*f* is inclined rearward as it advances in a relative rotation direction allowed by the ratchet mechanism 8 (hereinafter referred to as an "allowed rotating direction"). The tip end surface 3*f* is substantially parallel with a rear end surface 5*f* of a longitudinal rib 5*e* which will be described later.

On a rear end in the outer circumferential surface of the front end cylinder portion 3*a* of the operation cylinder 3, an O-ring groove 3*g* in which an O-ring R1 is attached is provided. The O-ring groove 3*g* extends annularly. The O-ring R1 is to give appropriate rotation resistance during relative rotation of the body cylinder 2 and the operation cylinder 3. The O-ring R1 functions as an annular elastic body for generating predetermined rotation resistance to the relative rotation.

The operation cylinder 3 has a pair of (a plurality of) projecting portions 20*a* constituting one of the cam mechanism 20 on the front end portion on its inner peripheral surface. The projecting portions 20*a* are guided by the guide portion 20*b* while relatively sliding with the guide portion 20*b*. As a result, the projecting portions 20*a* function as a driver for transmitting a rotating force to the guide portion 20*b* by sliding when the user relatively rotates the body cylinder 2 and the operation cylinder 3.

These projecting portions 20*a* are provided at positions each in equally distributed into two parts in the circumferential direction. These projecting portions 20*a* project by a predetermined length inward in the radial direction. Specifically, a region from the center to the front end of the front end cylinder portion 3*a* on the inner peripheral surface of the operation cylinder 3 has its diameter expanded so as to become a large-diameter inner peripheral surface 3*i*. The pair of projecting portions 20*a* each having a certain height are formed so as to be faced with each other on a front end of the large-diameter inner peripheral surface 3i. Moreover, in a region continuing to the rear sides of the projecting portions 20*a* in the large-diameter inner peripheral surface 3i, a hole portion 3*h* for molding the projecting portions 20*a* is formed. The hole portion 3*h* penetrates in the radial direction. The hole portion 3*h* has a rectangular shape having a circumferential width equal to the projecting portion 20*a* when seen from the radial direction.

As illustrated in FIGS. 1 and 5, this operation cylinder 3 is inserted into the body cylinder 2 from its front end cylinder portion 3*a*. The operation cylinder 3 has its annular groove portion 3*b* engaged with the projecting portion 2*c* of the body cylinder 2. As a result, the operation cylinder 3 is connected and attached in the axial direction to the body cylinder 2, capable of relative rotation. At this time, the O-ring R1 is fitted in the O-ring groove 3*g* in the operation cylinder 3. As a result, appropriate rotation resistance is given to the relative rotation of the body cylinder 2 and the operation cylinder 3. In order to reduce a production cost, the O-ring R1 (and the O-ring groove 3*g*) might not be provided.

Such operation cylinder 3 can be molded by resin by using a die and a core pin. Here, since the operation cylinder 3 has the hole portion 3*h*, by using a protruding portion for forming the hole portion 3*h* in the die, the projecting portion 20*a* can be molded. For example, when a slide core of the die and the core pin are assembled to each other, by the protruding portion of the slide core and the core pin, a predetermined space corresponding to the projecting portion 20*a* can be defined so as to be sandwiched in the axial direction and the perpendicular direction. As a result, when the core pin is to be removed after molding (that is, after a molten resin is filled/solidified in the predetermined space, and the projecting portion 20*a* is formed), by sliding the protruding portion of the slide core in a direction perpendicular to the axis, an undercut portion formed in the rear of the projecting portion 20*a* is opened, and the core pin can be pulled out easily in the axial direction.

Figure 7:
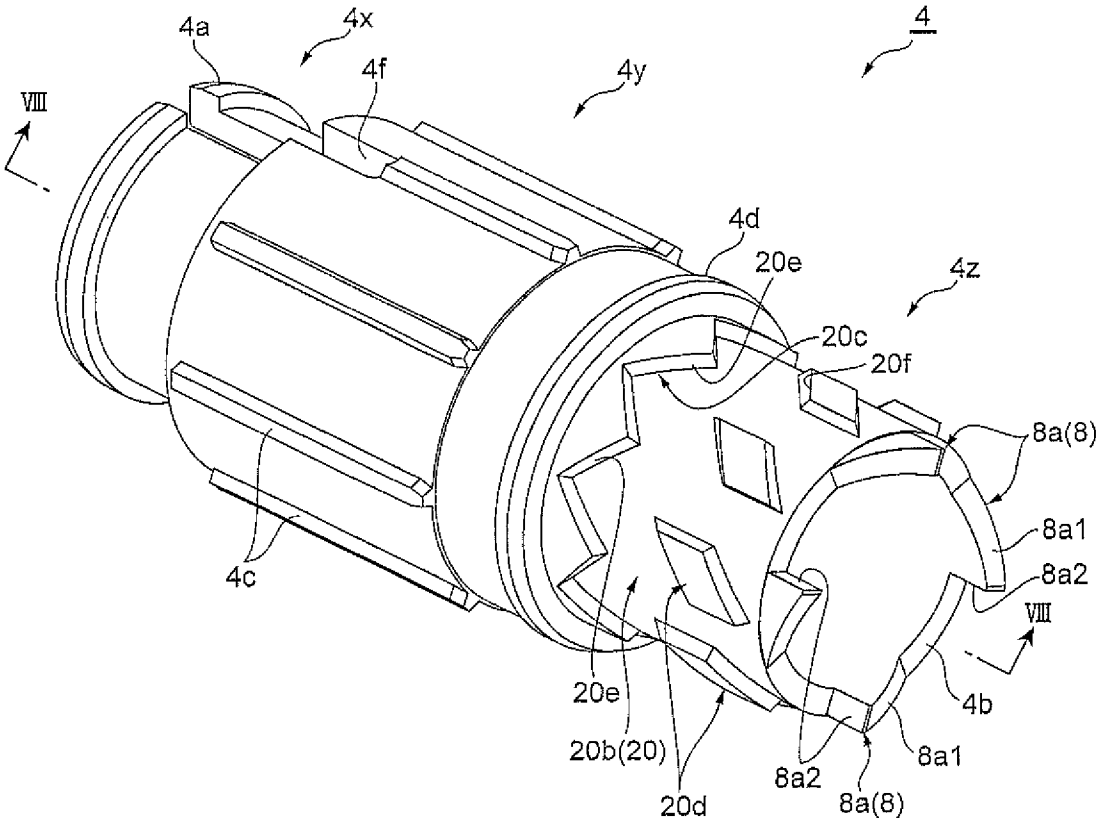
FIG. 7 is a perspective view illustrating a screw cylinder of the coating instrument in FIG. 1.
Figure 8:
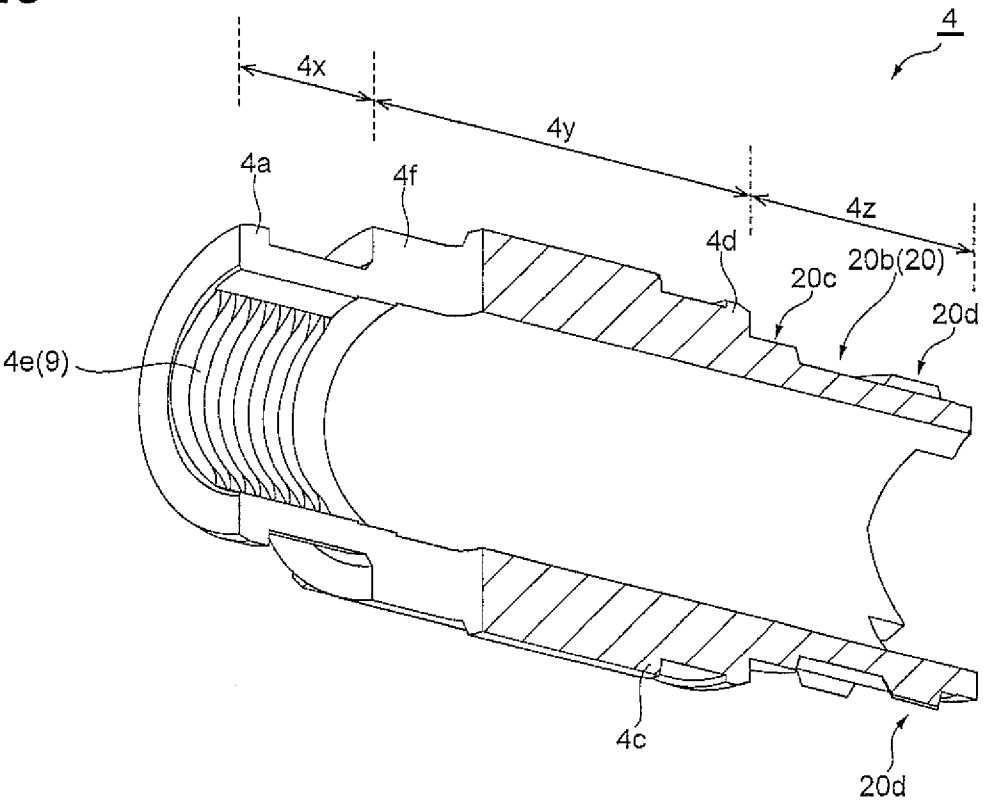
FIG. 8 is a sectional view along a line in FIG. 7.

FIG. 7 is a perspective view illustrating the screw cylinder. FIG. 8 is a sectional view along a VIII-VIII line in FIG. 7. As illustrated in FIGS. 7 and 8, the screw cylinder 4 is an injection molding by resin. The screw cylinder 4 presents a stepped cylindrical shape. The screw cylinder 4 has a front end cylinder portion 4*x*, a center cylinder portion 4*y* having an outer shape with a diameter larger than the front end cylinder portion 4*x*, and a rear end cylinder portion 4*z* having an outer shape with a diameter smaller than the center cylinder portion 4*y* in this order from the front to the rear. On the other hand, an inner peripheral surface of the screw cylinder 4 extends linearly along the axial direction without a step.

The front end cylinder portion 4*x* constitutes a front end portion of the screw cylinder 4. On an inner peripheral surface of the front end cylinder portion 4*x*, a female screw 4*e* constituting one of a screwing portion (extrusion mechanism) 9 is provided. As a pitch of the screwing portion 9 here, a fine pitch is employed, which is 0.5 mm, for example. On the front end portion on an outer peripheral surface of the front end cylinder portion 4*x*, a flange portion 4*a* for preventing expansion of an inner diameter of the female screw 4*e* by getting closer to the filling member 1 (see FIG. 1) is provided.

The center cylinder portion 4*y* constitutes a center part and the center part close to the front end of the screw cylinder 4. At a plurality of positions in the circumferential direction on the outer peripheral surface of the center cylinder portion 4*y*, a projection 4*c* to be engaged with the knurl 2*a* of the body cylinder 2 in the rotating direction is aimed. Moreover, on the outer peripheral surface of a rear end portion of the center cylinder portion 4*y*, an annular protruding portion 4*d* to be engaged with the projecting portion 2*d* of the body cylinder 2 in the axial direction is formed. On front end portions of the front end cylinder portion 4*x* and the center cylinder portion 4*y*, a pair of slits 4*f* penetrating in the radial direction and extending for a predetermined length in the axial direction are formed so as to face each other.

The rear end cylinder portion 4*z* constitutes a rear end part and the center part close to the rear end of the screw cylinder 4. On a rear end surface 4*b* of the rear end cylinder portion 4*z*, ratchet teeth 8*a* constituting the ratchet mechanism 8 are provided in plural along the circumferential direction. The ratchet teeth 8*a* are engaged with the ratchet member 5. The ratchet teeth 8*a* here are projected at positions each in equally distributed into four parts in the circumferential direction on the rear end surface 4*b*.

These ratchet teeth 8*a* form a serrated shape (wedge shape) along the circumferential direction and project from the rear end surface 4*b*. Specifically, a side surface 8*a*1 on the other side (the side brought into contact with the ratchet teeth 8*a* when the body cylinder 2 and the operation cylinder 3 are relatively rotated in one direction) in the circumferential direction in the ratchet teeth 8*a* is inclined with respect to the rear end surface 4*b* so as to form a mountain shape in the circumferential direction. On the other hand, a side surface 8*a*2 on the one side (the side brought into contact with the ratchet teeth 8*a* when the body cylinder 2 and the operation cylinder 3 are relatively rotated in the other direction) in the circumferential direction in ratchet teeth 8*a* is orthogonal to the rear end surface 4*b* and extended along the axial direction.

The rear end cylinder portion 4*z* has the guide portion 20*b* constituting the other of the cam mechanism 20 on its outer circumferential surface. The guide portion 20*b* guides sliding of the projecting portion 20*a* while relatively sliding the projecting portion 20*a* of the operation cylinder 3. The guide portion 20*b* functions as a follower to which a rotating force of the body cylinder 2 and the operation cylinder 3 is transmitted as a linear force in the longitudinal direction by sliding from the projecting portion 20*a*. A front side of the guide portion 20*b* is defined by a raised portion 20*c* raised with respect to the outer peripheral surface of the rear end cylinder portion 4*z*. The rear side of the guide portion 20*b* is defined by a plurality of guide pieces 20*d* as projections projecting with respect to the outer peripheral surface of the rear end cylinder portion 4*z*.

The raised portion 20*c* is provided on the front end portion of the rear end cylinder portion 4*z* so as to be raised by a predetermined length to the outside in the radial direction. A rear surface of the raised portion 20*c* forms a serrated shape (wedge shape) along the circumferential direction. The rear surface of the raised portion 20*c* is constituted by including a guide surface. 20*e* sliding with the projecting portion 20*a*. The guide surface 20*e* is inclined (crossed) with respect to a cross sectional surface.

The plurality of guide pieces 20*d* are provided on the rear end portion of the rear end cylinder portions 4*z* so as to project by a predetermined length to the outside in the radial direction. These guide pieces 20*d* are arranged separately from each other by a distance corresponding to the above described certain stroke on the rear of the raised portions 20*c*. The plurality of guide pieces 20*d* are juxtaposed along the circumferential direction with gaps wider than a width of the projecting portion 20*a* provided in the circumferential direction. The guide pieces 20*d* here are provided at positions each in equally distributed into eight parts in the circumferential direction.

As illustrates in FIGS. 1 and 7, the screw cylinder 4 is inserted into the body cylinder 2. The screw cylinder 4 has its annular protruding portion 4*d* engaged with the projecting portion 2*d* of the body cylinder 2 movably in the axial direction, and its projection 4*c* is engaged with the knurl 2*a* of the body cylinder 2 in the rotating direction. Moreover, the screw cylinder 4 has its rear end cylinder portion 4*z* inserted into the operation cylinder 3. As a result, the screw cylinder 4 is engaged with the body cylinder 2 in the rotating direction and is attached so as to be synchronically rotatable with respect to the body cylinder 2 and is made movable in the axial direction between the projecting portion 2*d* of the body cylinder 2 and the front end surface of the operation cylinder 3. At this time, the projecting portion 20*a* of the operation cylinder 3 advances along the axial direction into the guide portion 20*b* from a gap D between the plurality of guide pieces 20*d* in the guide portion 20*b*. As a result, the projecting portion 20*a* is assembled to the guide portion 20*b*, and the cam mechanism 20 is formed.

Such screw cylinder 4 can be molded by resin by using the slide core of the die and the core pin. Here, a four-way slide-core type die which can be divided into four parts in the circumferential direction is used. As a result, each of undercut shapes of the guide pieces 20*d* provided at positions each in equally distributed into eight parts in the circumferential direction can be formed smoothly.

Figure 9:
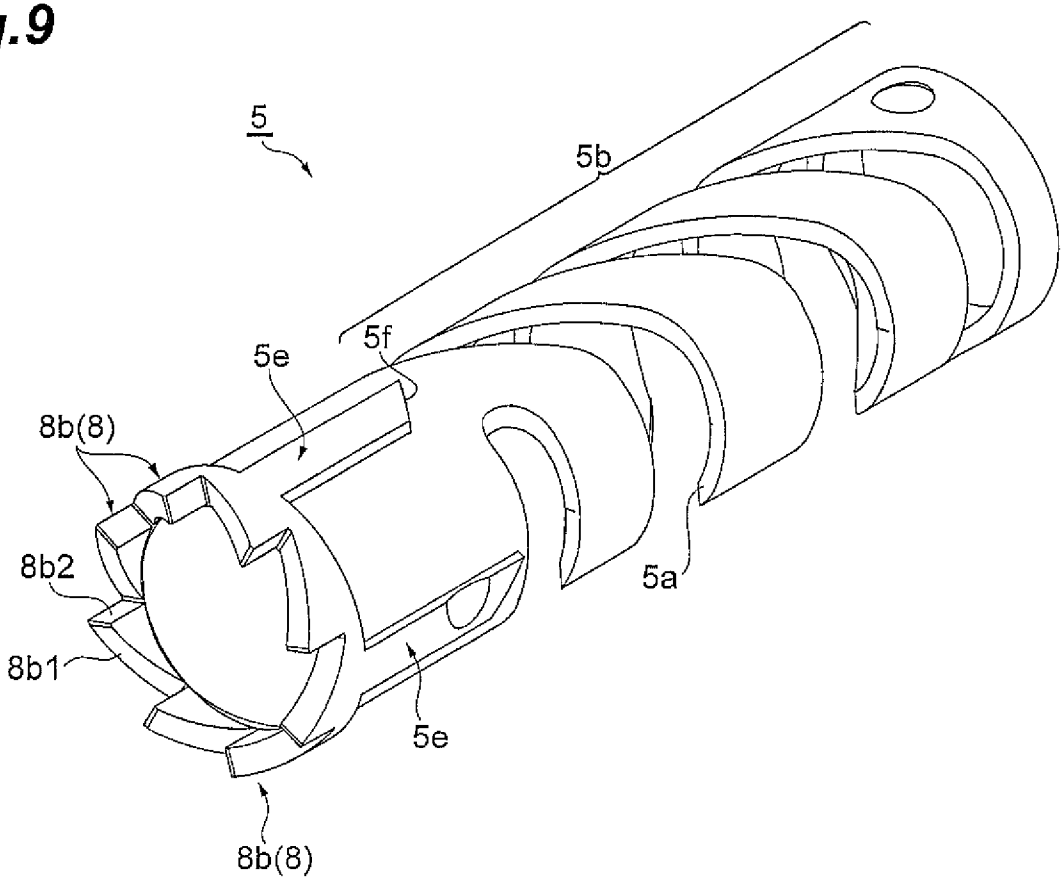
FIG. 9 is a perspective view illustrating a ratchet member of the coating instrument in FIG. 1.
Figure 10:
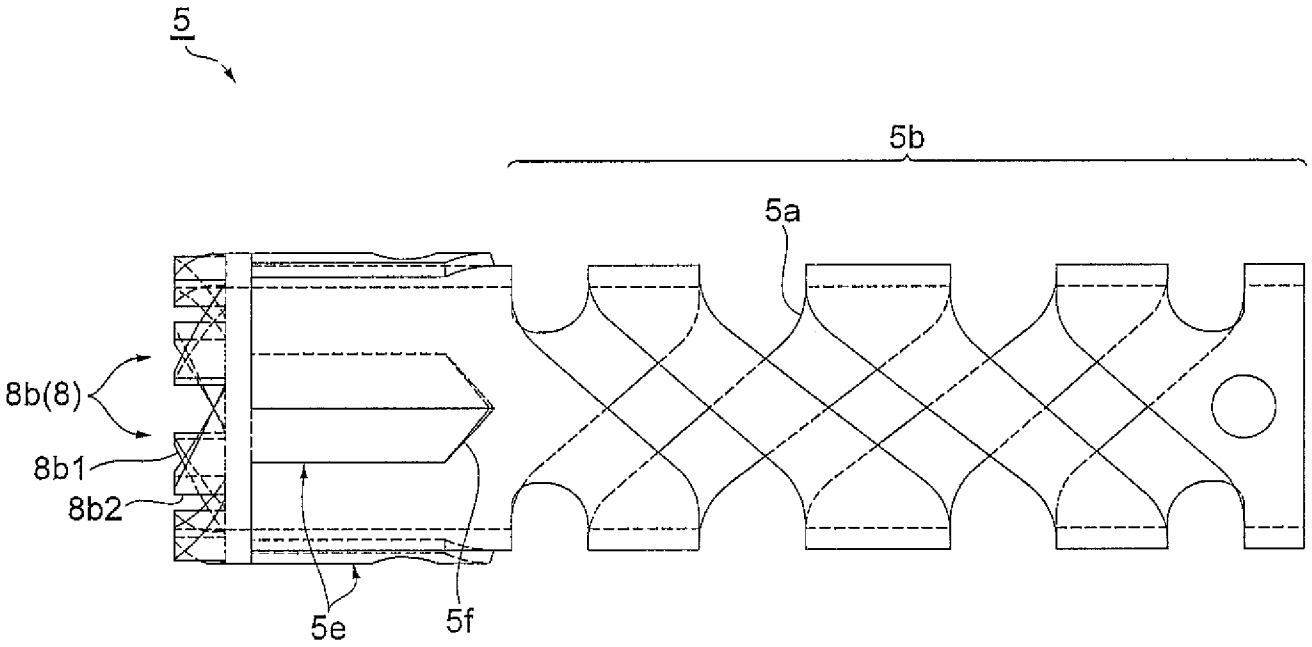
FIG. 10 is a plan view illustrating the ratchet member of the coating instrument in FIG. 1.

FIG. 9 is a perspective view illustrating the ratchet member, and FIG. 10 is a plan view illustrating the ratchet member. As illustrated in FIGS. 9 and 10, the ratchet member 5 is an injection molding by resin. The ratchet member 5 is constituted having a substantially cylindrical shape. On a front end surface of the ratchet member 5, the ratchet teeth 8*b* constituting the ratchet mechanism 8 are provided in plural along the circumferential direction. The ratchet teeth 8*b* are engaged with the ratchet teeth 8*a* of the screw cylinder 4. The ratchet teeth 8*b* here are projected at positions each in equally distributed into eight parts in the circumferential direction on the front end surface of the ratchet member 5.

These ratchet teeth 8*b* form a serrated shape (wedge shape) along the circumferential direction and project from the front end surface. Specifically, a side surface 8*b*1 on the one side (the side brought into contact with the side surface 8*a*1 of the ratchet teeth 8*a* when the body cylinder 2 and the operation cylinder 3 are relatively rotated in one direction) in the circumferential direction in the ratchet teeth 8*b* is inclined with respect to the front end surface so as to form a mountain shape in the circumferential direction. On the other hand, a side surface 8*b*2 on the other side (the side brought into contact with the side surface 8*a*2 of the ratchet teeth 8*a* when the body cylinder 2 and the operation cylinder 3 are relatively rotated in the other direction) in the circumferential direction in the ratchet teeth 8*b* is orthogonal to the front end surface and extended along the axial direction.

In a portion from the center part to the rear end in a peripheral wall of this ratchet member 5, a substantially spiral slit 5*a* is formed. As a result, the ratchet member 5 has a function as a spring portion 5*b* urging the ratchet teeth 8*b* forward which is the ratchet teeth 8*a* side. On the front end portion of the outer peripheral surface of the ratchet member 5, a longitudinal rib 5*e* to be engaged with the projection 3*e* of the operation cylinder 3 in the rotating direction is provided. The longitudinal rib 5*e* has a predetermined width in the circumferential direction and extends in the axial direction.

The longitudinal ribs 5*e* are provided at positions each in equally distributed into eight parts in the circumferential direction on the front end portion on the outer circumferential surface of the ratchet member 5. The rear end surface 5*f* of the longitudinal rib 5*e* is inclined forward with respect to the cross sectional surface as it goes to the other side in the circumferential direction on a radial direction view. In other words, the rear end surface 5*f* is inclined forward as it goes in an allowed rotating direction of the ratchet member 5. The rear end surface 5*f* is made substantially parallel with the tip end surface 3*f* of the projection 3*e* in the operation cylinder 3.

As illustrated in FIGS. 1 and 9, the ratchet member 5 is inserted into the operation cylinder 3 from its rear side. The ratchet member 5 has its longitudinal ribs 5*e* advancing between the projections 3*e* and 3*e* of the operation cylinder 3, and the longitudinal ribs 5*e* are engaged with the projections 3*e* in the rotating direction. At the same time, the ratchet member 5 is abutted against the rear end side of the screw cylinder 4, and its ratchet teeth 8*b* are made engageable with the ratchet teeth 8*a* of the screw cylinder 4. As a result, the ratchet member 5 is assembled to the operation cylinder 3 in a state in which the relative rotation is regulated by the ratchet teeth 8*a* and 8*b* so that the relative rotation is possible only in the allowed rotating direction with respect to the screw cylinder 4.

The ratchet member 5 is sandwiched in the axial direction by the rear end side of the screw cylinder 4 and the bottom surface of the operation cylinder 3. The ratchet member 5 has the ratchet teeth 8*b* urged to the front side by an urging force (elastic force) generated by its spring portion 5*b*. As a result, the ratchet teeth 8*a* and 8*b* engaged with each other are brought into a state of click engagement.

When the longitudinal ribs 5*e* are made to advance between the projections 3*e* and 3*e* so as to be engaged with the projections 3*e* in the rotating direction, if their positions in the rotating direction are shifted from each other, and the rear end surface 5*f* of the longitudinal rib 5*e* and the tip end surface 3*f* of the projection 3*e* are brought into contact with each other, the rear end surface 5*f* and the tip end surface 3*f* are the above described slopes. Therefore, the relative rotation of the ratchet member 5 in the allowed rotating direction is prompted, while the relative rotation of the ratchet member 5 to the side opposite to the allowed rotating direction is regulated. Thus, in this case, the ratchet member 5 is relatively rotated in the allowed rotating direction, and the longitudinal ribs 5*e* are made to advance between the projections 3*e* and 3*e* while being moved in the allowed rotating direction with respect to the projections 3*e*. As a result, forced relative rotation of the ratchet member 5 to the side opposite to the allowed rotating direction in order to engage the longitudinal ribs Se with the projections 3*e* can be suppressed. As a result, breakage of the ratchet teeth 8*a* and 8*b* and other rotary engagement portions caused by forced relative rotation can be suppressed.

Returning to FIG. 1, the moving body 6 is constituted having a cylindrical shape. The moving body 6 is provided with a male screw 6*b* constituting the other of the screwing portion 9 on an outer circumferential surface from a rear side of its front end portion to a rear end portion. Moreover, at positions each in equally distributed into six parts in the circumferential direction on an inner circumferential surface of the moving body 6, projections 6*c* constituting the other of a retaining portion of the moving body 6 are provided. The projections 6*c* project to an inside in the radial direction and extend in the axial direction. The moving body 6 is externally inserted into the shaft body 3*c* of the operation cylinder 3 and is also internally inserted into the screw cylinder 4. In the moving body 6, its male screw 6*b* is screwed with the female screw 4*e* of the screw cylinder 4. Along with that, in the moving body 6, its projections 6*c* are engaged between the projections 3*d* and 3*d* of the shaft body 3*c* (see FIG. 5) and are engaged with the operation cylinder 3 in the rotating direction and attached capable of movement in the axial direction.

The piston 7 is molded from TPEE (polyester elastomers) TPU (polyurethane elastomers), PP (polypropylene), HDPE (high-density polyethylene), LLDPE (linear low-density polyethylene) and the like having a color tone (white, for example) different from the color tone of the coating material M. The piston 7 is formed having a substantially columnar outer shape. The piston 7 has its front end surface forming a planar shape orthogonal to the axial direction, and a recess portion is recessed on its rear end surface. That is, the piston 7 has a flat front surface and has a U-shape opened to the rear on a longitudinal sectional view. On an inner peripheral surface of the recess, an annular projecting portion 7*b* capable of moving for a predetermined length in the axial direction with respect to the moving body 6 and engaged with the same is provided.

On an outer peripheral surface of the piston 7, as illustrated in FIG. 4, a protruding portion 7*c* which is brought into contact (close contact) with the filling member 1 and makes the filling region 1*x* airtight is provided as a region to be in close contact with the filling member 1. Such piston 7 is externally inserted into the front end portion of the moving body 6. The piston 7 has its annular projecting portion 7*b* engaged with the moving body 6 in the axial direction. As a result, the piston 7 is attached capable of movement in the axial direction (movable within a predetermined range) with respect to the moving body 6.

Figure 11:
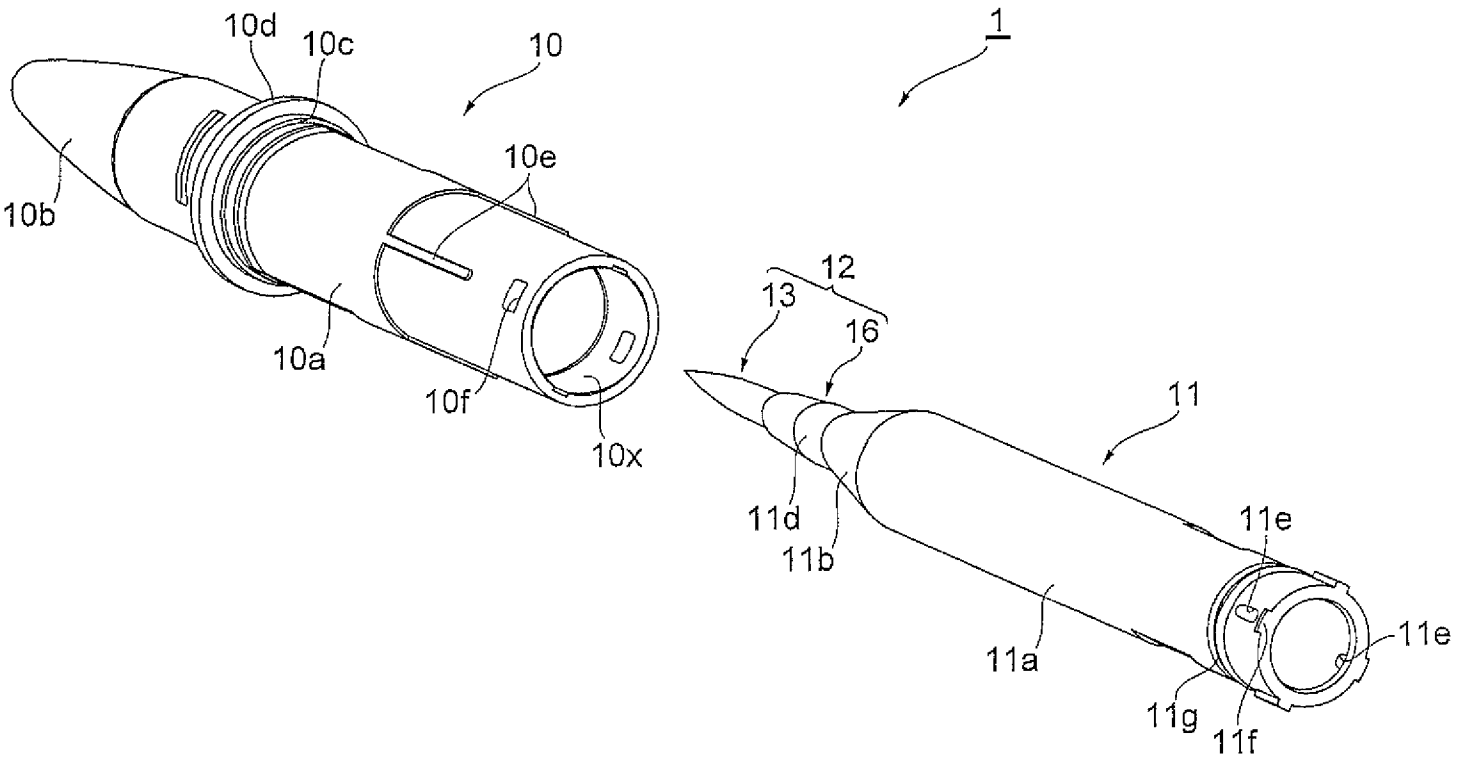
FIG. 11 is an exploded perspective view illustrating a filling material in the coating instrument in FIG. 1.

FIG. 11 is an exploded perspective view illustrating the filling member. As illustrated in FIGS. 1 and 11, the filling member 1 is formed of injection molding plastics such as polyethylene terephthalate (PET), polybutylene terephthalate (PBT), polycyclohexane dimethylene terephthalate (PCTA), polypropylene (PP) and the like excellent in anti-permeability of a volatile solvent. The filling member 1 is constituted by including an outer filling cylinder 10 constituting surroundings, an inner filling cylinder 11 defining the filling region 1*x* inside this outer filling cylinder 10, and a pen point member 12 constituting the tip end portion of the filling member 1 and applying the coating material M.

As illustrated in FIG. 11, the outer filling cylinder 10 is formed of a colored material (black, for example), and has a cylindrical body portion 10*a* and a tapered portion 10*b* continuing to the front side of the body portion 10*a*. The body portion 10*a* has an annular recess portion 10*c* at a center in the axial direction on its outer peripheral surface. The annular recess portion 10*c* is engaged with the annular projecting portion 2*b* of the body cylinder 2 in the axial direction. In the body portion 10*a*, on a front side of the annular recess portion 10*c* on its outer peripheral surface, an annular flange portion 10*d* is provided. The flange portion 10*d* is brought into contact with a front end surface of the body cylinder 2. On a rear end portion on the outer peripheral surface of the body portion 10*a*, a knurl 10*e* engaged with the knurl 2*a* of the body cylinder 2 in the rotating direction is provided. In the knurl 10*e*, a large number of projections and recesses are juxtaposed in the circumferential direction, and the projections and recesses are extended for a predetermined length in the axial direction.

The body portion 10*a* has a hole portion 10*f* as a channel portion (second channel portion) through which air and a part of the coating material M are made to flow and also in order to check a filling position of the coating material M and to engage the inner filling cylinder 11. The hole portion 10*f* has a rectangular sectional shape. The hole portion 10*f* is provided in a pair at positions faced with each other on a peripheral wall of the rear end portion of the body portion 10*a*. These hole portions 10*f* extend in the radial direction and penetrate the peripheral wall from inside to outside. As illustrated in FIGS. 4 and 11, the rear end portion on the inner peripheral surface of this body portion 10*a* has an expanded portion formed so that its inner diameter is expanded. The expanded portion constitutes a wall portion (first wall portion) 10*x*. The wall portion 10*x* covers an opening $\mathbf{11}_{out}$ on a side (outside the filling region 1*x*) opposite to the filling region 1*x* side in the hole portion 11*e* of the inner filling cylinder 11 which will be described later with a gap. The wall portion 10*x* has a function of guiding a part of the coating material M flowing out of the hole portion 11*e* to the rear side.

The tapered portion 10*b* presents a tapered frustum cylindrical shape. The tapered portion 10*b* has a section of a flat circular outer shape. On a front end portion of the tapered portion 10*b*, an opening 10*g* (see FIG. 1) having a flat circular section is formed. On a front side of the flange portion 10*d* on the outer peripheral surface of the body portion 10*a*, an O-ring groove 10*h* (see FIG. 1) extending annularly is provided. The O-ring groove 10*h* has an O-ring R2 fitted and attached. The O-ring R2 functions as an annular elastic body which improves airtightness and fitting stability in a cap C1 which will be described later.

The inner filling cylinder 11 is formed of a transparent material. The inner filling cylinder 11 has light permeability such that the coating material M in the filling region 1*x* therein can be seen through. The inner filling cylinder 11 has a cylindrical body portion 11*a*, a tapered portion 11*b* continuing to a front side of the body portion 11*a*, and a front end portion 11*d* continuing to a front side of the tapered portion 11*b* through a step.

The body portion 11*a* has the hole portion 11*e* as a channel portion (first channel portion) through which air and a part of the coating material M in the filling region 1*x* is made to flow to the outside of the filling region 1*x*. The hole portion 11*e* is formed in a pair at positions faced with each other on a peripheral wall of a rear end portion of the body portion 11*a*. The hole portion 11*e* extends in the radial direction and penetrates the peripheral wall from the inside to the outside. These hole portions 11*e* are arranged at the same positions as those of the hole portions 10*f* in the circumferential direction. The hole portion 11*e* has an oval sectional shape which is lengthy in the axial direction, or in other words, has a track sectional shape extending for a predetermined length in the axial direction. On a rear side of the hole portion 11*e* on an outer peripheral surface of the body portion 11*a*, a protruding portion 11*f* engaged with the hole portion 10*f* of the outer filling cylinder 10 in the axial direction is provided.

The tapered portion 11*b* presents a tapered frustum cylindrical shape having a section of a flat circular outer shape. The front end portion 11*d* presents a cylindrical shape having a flat circular cross sectional outer shape. As illustrated in FIG. 1, this inner filling cylinder 11 is inserted into and attached to the outer filling cylinder 10. At this time, a gap 11*h* is formed between a front end of the inner filling cylinder 11 and the outer filling cylinder 10. The gap 11*h* constitutes an engagement groove for engaging a plug C2 which will be described later.

Figure 12A:
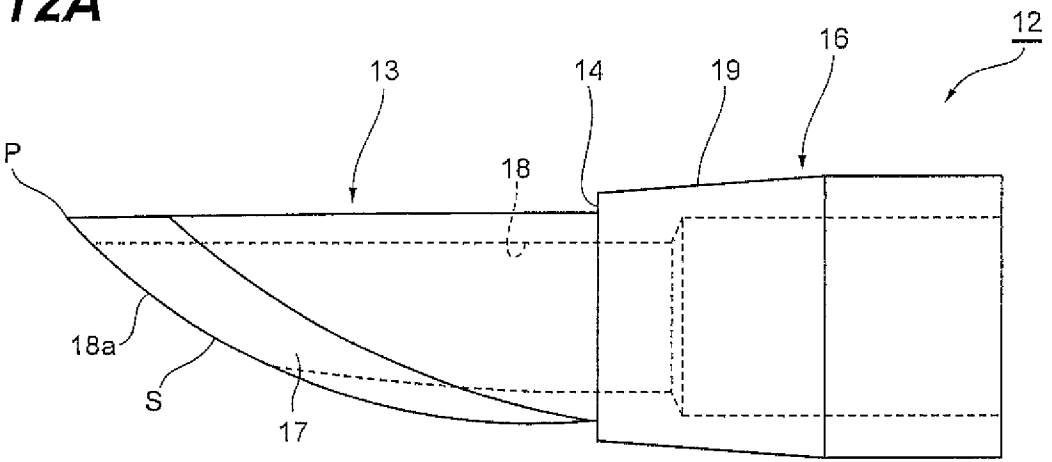
FIG. 12A is a front view illustrating a pen point member in the coating instrument in FIG. 1.
Figure 12B:
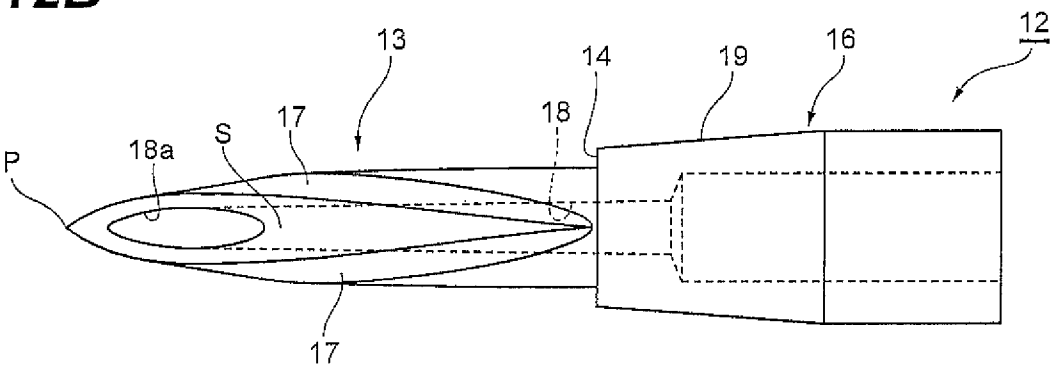
FIG. 12B is a bottom view illustrating the pen point member in the coating instrument in FIG. 1.

FIG. 12A is a front view illustrating a pen point member in the coating instrument in FIG. 1, and FIG. 12B is a bottom view illustrating the pen point member in the coating instrument in FIG. 1. As illustrated in FIGS. 12, the pen point member 12 is for applying the coating material M. The pen point member 12 is formed of a soft material. As the soft material, thermosetting general rubber heated and molded by vulcanization, for example, and thermoplastic elastomer which is a kind of plastic and vulcanized by heat and molded by being cast in a die can be used.

Examples of the general rubber include, mainly, nitrile rubber (NBR), butyl rubber (BR), ethylenepropylene rubber (EPDM), and silicone rubber (Si). Among them, particularly the nitrile rubber is excellent in oil resistance against the above described volatile solvents. Examples of the thermoplastic elastomer include, mainly, polyester elastomers (TPEE), olefin elastomers (TPO), and urethane elastomers (TPU). Among them, in the urethane elastomers, polyurethane can be used for a hard segment, and either one of two types, that is, polyester or polyether can be used for a soft segment. For the coating material M, those having polyether for the soft segment are particularly suitable.

Moreover, the pen point member 12 has hardness by a type-A durometer specified by JIS K 6253 of 40 to 80. As this pen point member 12, any coating portion such as a soft pen point can be used. As illustrated, the pen point member 12 includes a pointed pen point 13 on a tip end side and a base end portion 16 continuing to a base end side of the pen point 13 through a stepped portion 14.

The pen point 13 is formed having a section of a flat circular outer shape and a knife shape on a side view. The flat circle of the outer shape of the section has a vertical direction in FIG. 12A as a long axis direction. Along with that, the flat circle of the outer shape of the section has a vertical direction in FIG. 12B as a short axis direction. In this pen point 13, a coating surface S is constituted by its tip end surface. The coating surface S is brought into contact with a coating target such as a skin or the like of the user. The coating surface S has a flat circular curved surface which is swollen to a front side and elongated longitudinally. At a tip end of the coating surface S, a top P is formed. By rounding the top P into a small spherical top (by providing a spherical surface with a small radius (R) on the top P), an impact on the skin which is a portion to be coated can be adjusted to become soft.

On a region from an outer edge of the coating surface S to a base end side by a predetermined length on both side surfaces of the pen point 13, a tapered surface 17 is formed. The tapered surface 17 is inclined so as to be tapered toward the coating surface S side. At an axial position of the pen point 13, a through hole 18 having a circular section and extending along the axial direction is formed. An opening portion of the coating surface S in the through hole 18 forms a discharge outlet 18*a* for discharging the coating material M. The discharge outlet 18*a* is made small to a degree that the coating material M in a molten state and filled in the filling region 1*x* does not flow down from the discharge outlet 18*a*. Here, the discharge outlet 18*a* has a predetermined diameter.

The base end portion 16 presents a cylindrical flat circular shape whose outer shape of a section has a diameter larger than the pen point 13. In a region from a front end to a center on an outer peripheral surface of the base end portion 16, a tapered surface 19 engaged with the tapered portion 10*b* of the outer filling cylinder 10 is formed. The tapered surface 19 is inclined so as to be tapered.

As illustrated in FIGS. 1, 11, and 12, the pen point member 12 has its base end portion 16 externally inserted into the front end portion 11*d* of the inner filling cylinder 11. The pen point member 12 is engaged and brought into close contact with the inner filling cylinder 11 in the rotating direction. In this state, the pen point member 12 has its pen point 13 internally inserted into the opening 10*g* of the outer filling cylinder 10 and is engaged with and attached to the outer filling cylinder 10 in the rotating direction. That is, by assembling the pen point member 12 to the inner filling cylinder 11 and by assembling this to the outer filling cylinder 10, the outer filling cylinder 10, the inner filling cylinder 11, and the pen point member 12 are attached to each other as the filling member 1. Moreover, the pen point member 12 has its stepped portion 14 engaged with the front end portion of the outer filling cylinder 10 in the axial direction. Along with that, the pen point member 12 has a rear end surface of its base end portion 16 engaged with the inner filling cylinder 11 in the axial direction. As a result, the pen point member 12 is sandwiched and held in the axial direction by the outer filling cylinder 10 and the inner filling cylinder 11.

Then, the filling member I is internally inserted into the body cylinder 2 from its rear portion side. The filling member 1 has the annular recess portion 10*c* of its outer filling cylinder 10 engaged with the annular projecting portion 2*b* of the body cylinder 2. Along with that, in the filling member 1, the knurl 10*e* of its outer filling cylinder 10 is engaged with the knurl 2*a* of the body cylinder 2. As a result, the filling member 1 is engaged with and attached to the body cylinder 2 in the axial direction and the rotating direction and is integrated with the body cylinder 2. Along with that, as will be described below in detail, in the filling member 1 in which the coating material M is filled, the piston 7 is inserted into and attached to the rear end portion of its inner filling cylinder 11 so that the piston 7 is in close contact airtightly.

On the discharge outlet 18*a* of the pen point member 12 of the filling member 1, the plug C2 is fitted/inserted and detachably attached. As a result, the filling region 1*x* is sealed (made airtight). Moreover, in the outer filling cylinder 10 of the filling member 1, the cap C1 is screwed/fitted through the O-ring R2 (detachably attached). As a result, an inside of the cap C1 is brought into an airtight state. The screw cylinder 4 is internally inserted so that the flange portion 4*a* (see FIG. 7) of the screw cylinder 4 is brought close to an inner surface of the outer filling cylinder 10 of the filling member 1. As a result, expansion of the inner diameter of the female screw 4*e* can be prevented. Moreover, by attaching a cylindrical inner cap into the cap C 1 so as to reduce a space inside the cap C1, evaporation of the coating material M can be further suppressed.

Subsequently, an example of filling and assembling of the coating material M in the above described coating instrument 100 (a method for manufacturing the coating instrument 100) will be described in detail.

Figure 13A:
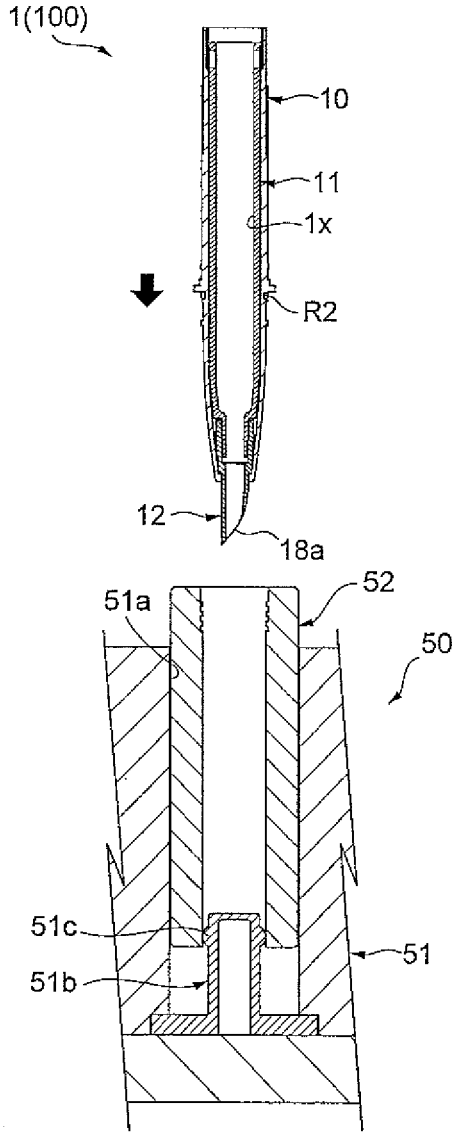
FIG. 13A is a sectional view for explaining filling of the coating material in the coating instrument in FIG. 1.

FIGS. 13 and 14 are sectional views for explaining filling of the coating material by the coating instrument. As illustrated in FIG. 13A, when the coating material M is to be filled in the filling region 1*x*, first, a filling jig 50 is prepared. The filling jig 50 is constituted by including a cylinder 51 in which a recess portion 51*a* having a circular section opened upward is formed and a cylindrical piston 52 slidably inserted into the recess portion 51 a from above. At a center part on a bottom surface of the recess portion 51*a*, a protruding portion 51*b* inserted into the piston 52 is formed. The protruding portion 51*b* presents a columnar outer shape and is constituted by projecting upward. On a side surface of the protruding portion 51*b*, an annular protruding portion 51*c* which is slidable with respect to the piston 52 and is brought into contact airtightly is formed.

Subsequently, in a state in which a predetermined gap is formed between the bottom surface of the recess portion 51*a* of the cylinder 51 and a lower end of the piston 52, that is, in a state in which the protruding portion 51*b* is inserted into the piston 52 so that the annular protruding portion 51*c* is brought into contact with the lower end portion of the piston 52, the filling member 1 is inserted into the piston 52 from above. At this time, the filling member 1 is arranged in a standing attitude with its tip end located below (the front side is located below the rear side) so that the tip end is located closer to the lower center of the piston 52. Then, the O-ring R2 of the filling member 1 is in contact in an airtight manner on an inner surface of an upper part of the piston 52, and the filling member 1 is fixed to an upper end portion of the piston 52.

Figure 13B:
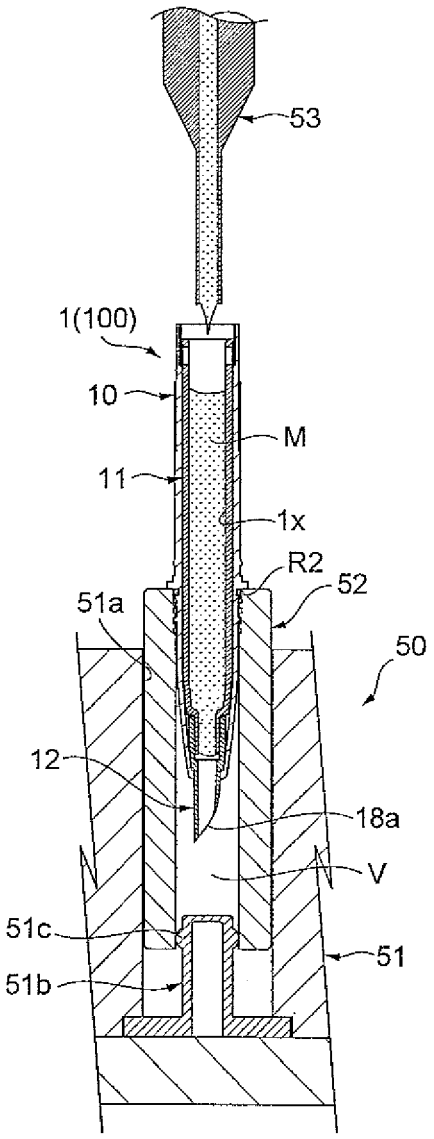
FIG. 13B is a sectional view illustrating the subsequent process of FIG. 13A.

Subsequently, as illustrated in FIG. 13B, the coating material M solved by raising a temperature to approximately 80° C. is poured by a fixed amount into the inner filling cylinder 11 from behind the inner filling cylinder 11 through a nozzle 53. As a result, the coating material M fills the inside of the filling region 1*x*. Along with that, in a periphery of the filling member 1 (coating instrument 100) in the piston 52, an airtight space V in which the discharge outlet 18*a* is located is formed. Considering delay in fluidity caused by viscosity of the coating material M, the coating material M may be left for a predetermined time immediately after filling. In this case, the coating material M can be reliably spread in the filling region 1*x*.

Figure 14A:
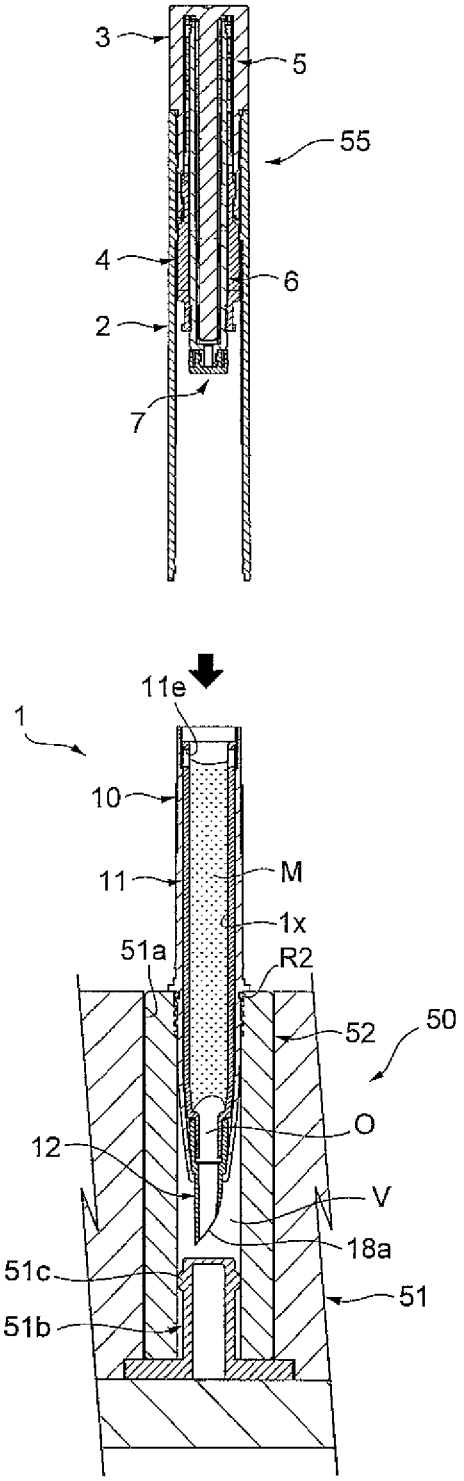
FIG. 14A is a sectional view illustrating the subsequent process of FIG. 13B.

Subsequently, as illustrated in FIG. 14A, the piston 52 is slid below and relatively moved with respect to the cylinder 51. Specifically, the piston 52 to which the filling member 1 is fixed is pushed downward until the lower end of the piston 52 is brought into contact with the bottom surface of the recess portion 51*a* of the cylinder 51. As a result, a volume of the airtight space V is contracted, and the inside of the airtight space V is pressurized. As a result, air in the airtight space V advances by a predetermined amount into the filling region 1*x* through the discharge outlet 18*a*. Along with that, the coating material M in the filling region 1*x* is pushed upward. That is, a predetermined amount of air is fed into the filling region 1*x* from the discharge outlet 18*a* so that a space O is formed on the tip end side (discharge outlet 18*a* side) in the filling region 1*x*.

Considering delay in fluidity caused by viscosity of the coating material M, the coating material M may be left for a predetermined time immediately after pushing in the piston 52. In this case, the space O can be reliably formed in the filling region 1*x*. Here, as the result of feeding the air into the filling region 1*x* so that the space O having a certain amount is formed, the coating material M is raised up to the middle (center) of the hole portion 11*e* in the axial direction, for example. The certain amount can be set as appropriate in accordance with specification and the like. Moreover, the certain amount can be set as appropriate also on the basis of correlation of an ambient temperature and a change in air pressure to an expansion rate of the coating material M and the like, for example.

Figure 14B:
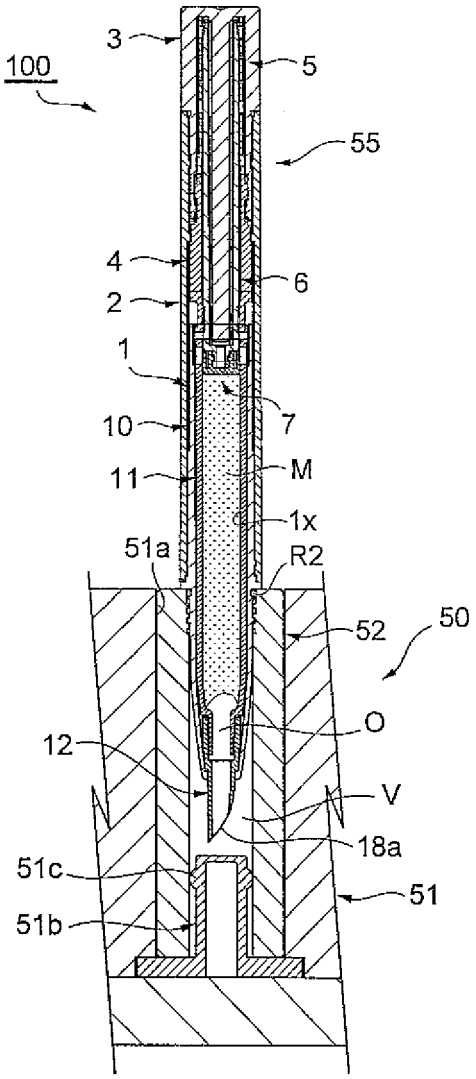
FIG. 14B is a sectional view illustrating the subsequent process of FIG. 14A.
Figure 15A:
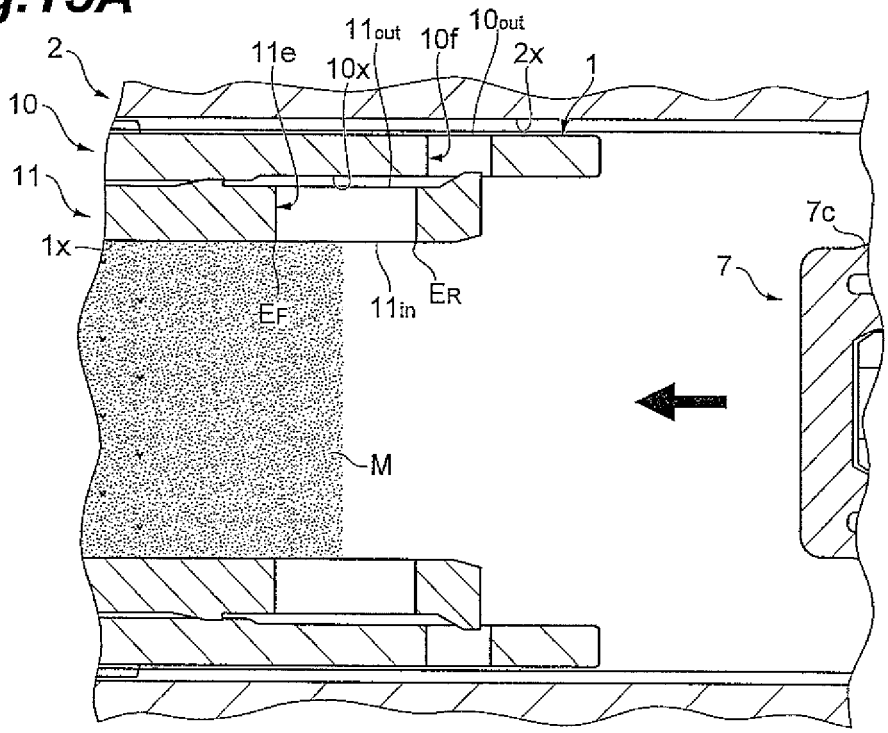
FIG. 15A is a sectional view for explaining assembling of the coating instrument in FIG. 1.

Subsequently, as illustrated in FIG. 14B, a body portion 55 in which the body cylinder 2, the operation cylinder 3, the screw cylinder 4, the ratchet member 5, the moving body 6, and the piston 7 are assembled to each other is attached to the filling member 1 from behind. Specifically, as illustrated in FIG. 15A, the piston 7 is advanced from behind the inner filling cylinder 11, and the piston 7 is inserted into and attached to the inner filling cylinder 11 so that the protruding portion 7*c* of the piston 7 is brought into contact with the inner peripheral surface of the inner filling cylinder 11.

Figure 15B:
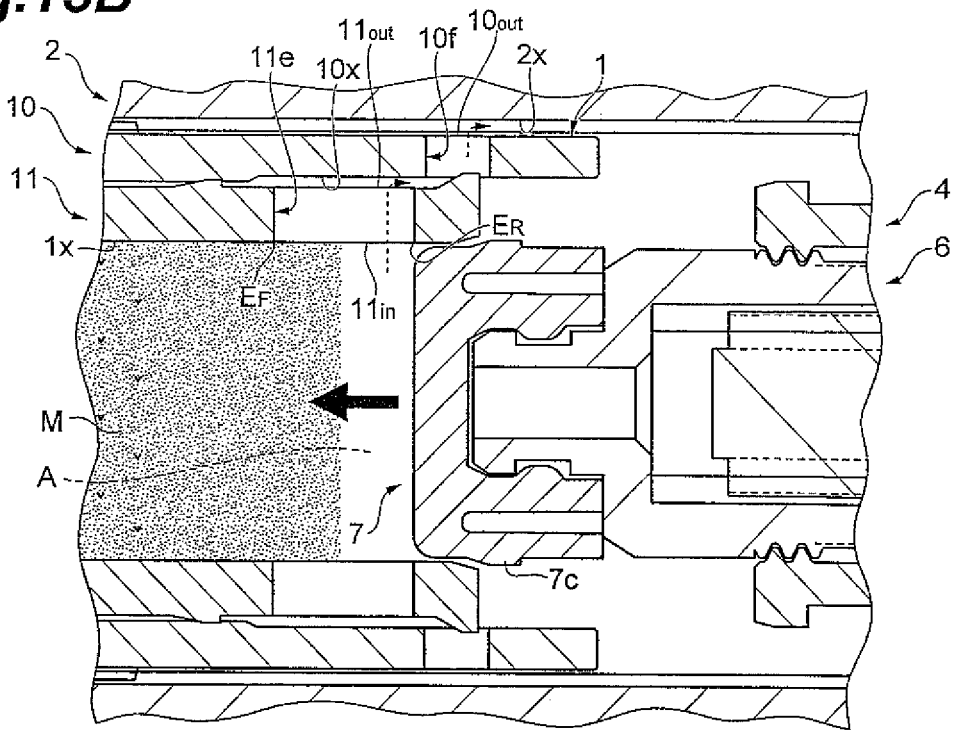
FIG. 15B is a sectional view illustrating the subsequent process of FIG. 15A.

Here, as illustrated in FIG. 15B, when a front end surface of the piston 7 is drawn near a rear end $E_R$ of an opening $\mathbf{11}_{in}$ in the hole portion 11*e* and after, an air A between the coating material M and the piston 7 is positively pushed out to the outside of the filling region 1*x* through the hole portion 11*e*. That is, from the time when the front end of the piston 7 is arranged in front of the rear end $E_R$ of the opening $\mathbf{11}_{in}$ in the hole portion 11*e*, the air A between the coating material M and the piston 7 is positively made to flow out (discharged) to the outside of the filling region 1*x* through the hole portion 11*e*. At least a part of the air A having passed through the hole portion 11*e*, for example, is guided by the wall portion 10*x* and flows to the rear between the inner filling cylinder 11 and the outer filling cylinder 10 and is positively made to flow out to the outside of the filling member 1 further through the hole portion 10*f*.

Figure 16A:
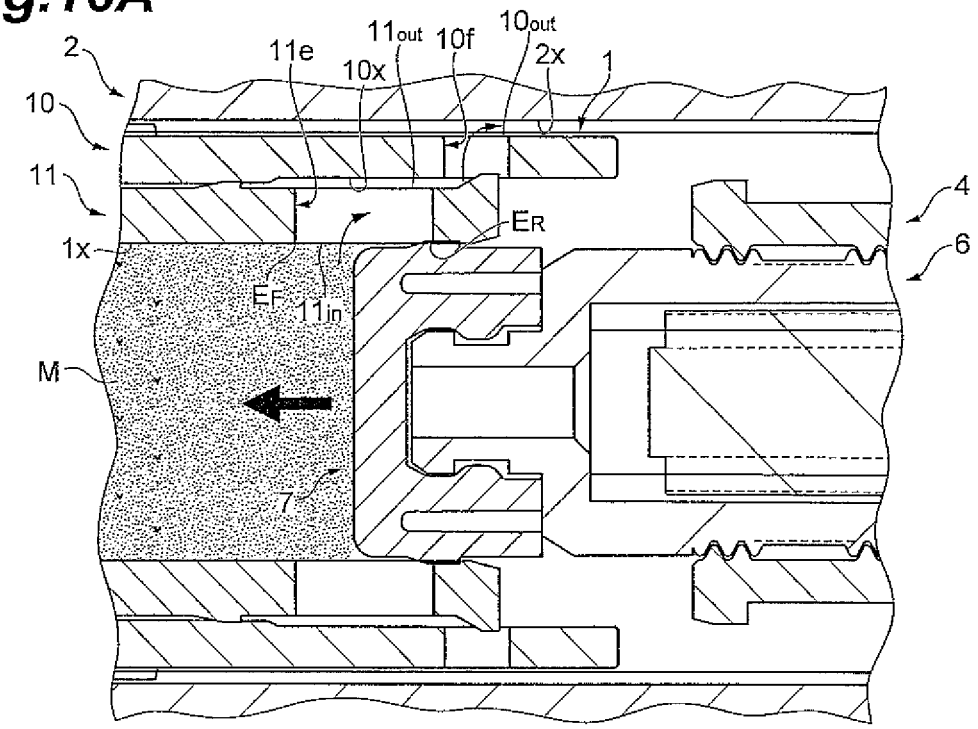
FIG. 16A is a sectional view illustrating the subsequent process of FIG. 15B.

Moreover, as illustrated in FIG. 16A, when the front end surface of the piston 7 reaches the middle of the opening $\mathbf{11}_{in}$ in the axial direction, and the piston 7 contacts with the coating material M and after, the coating material M is positively pushed out to the outside of the filling region 1*x* through the hole portion 11*e*. That is, from the time when the air A is no longer present between the coating material M and the piston 7, the coating material M is positively made to flow out to the outside of the filling region 1*x* through the hole portion 11*e*. The coating material M having passed through the hole portion 11*e* is guided by the wall portion 10*x* and flows to the rear through a space between the inner filling cylinder 11 and the outer filling cylinder 10, for example.

A part of the coating material M having flowed to the rear flows into the screw cylinder 4 through the slits 4*f* (see FIG. 7) of the screw cylinder 4 and reaches the screwing portion 9. Along with that, the other parts of the coating material M is positively made to flow out to the outside of the filling member 1 further through the hole portion 10*f*. The coating material M having passed through the hole portion 10*f* is guided by the wall portion 2*x* and flows to the rear between the outer filling cylinder 10 and the body cylinder 2. This part of the coating material M also flows into the screw cylinder 4 through the slits 4*f* of the screw cylinder 4 and reaches the screwing portion 9.

Moreover, from the time when the protruding portion 7*c* of the piston 7 is arranged on the front beyond the opening $\mathbf{11}_{in}$ and the protruding portion 7*c* is brought into close contact with the inner peripheral surface of the inner filling cylinder 11 on the front of the opening $\mathbf{11}_{in}$ and after, the filling region 1*x* and the hole portion 11*x* are made non-communicable. As a result, the rear end portion of the filling region 1*x* is made further airtight.

Figure 16B:
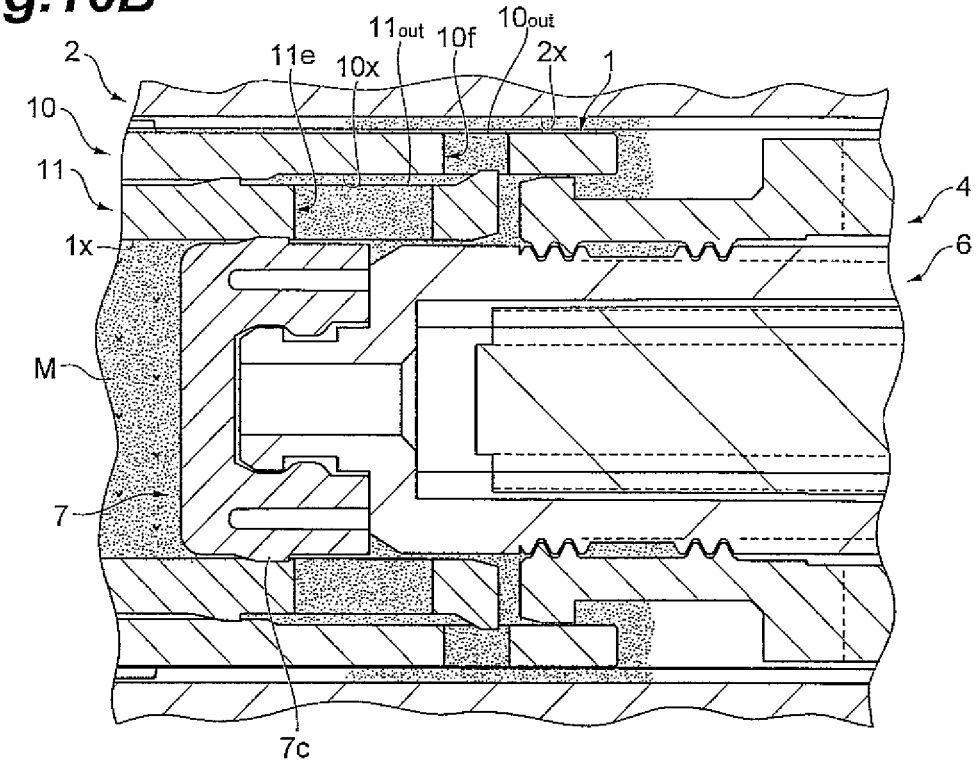
FIG. 16B is a sectional view illustrating the subsequent process of FIG. 16A.

As described above, as illustrated in FIG. 16B, attachment of the piston 7 is completed. When the piston 7 is located at a retreat limit (the most rear position within the movable range) as the initial state, a part of the coating material M is made to flow out to the outside of the filling region 1*x* through the hole portion 11*e*. Here, the part of the coating material M is present in the container at least between the hole portions 11*e*, 10*f* and the filling cylinders 10, 11, between the body cylinder 2 and the filling member 1, and in the periphery of the screwing portion 9.

As described above, in this embodiment, after the air is fed into the filling region 1*x* in which the coating material M is filled from the discharge outlet 18*a*, the body portion 55 is assembled to the filling member 1. As a result, the space O having the certain amount can be reliably ensured on the tip end side in the filling region 1*x*. Even if the coating material M is swollen or like due to a temperature change or a change in the air pressure, unintended leakage of the coating material M from the discharge outlet 18*a* can be reliably prevented by the space O having the certain amount. As a result, even in a product test for determining presence of leakage of the coating material M under an ambient environment at 50° C., for example, the product can reliably pass the test.

As a prior-art method for filling the coating material Min the filling region 1*x*, there is a method in which the filling member 1 in a state in which the pen point member 12 is removed and the body portion 55 are assembled in advance, the coating material M is filled in the filling region 1*x* from the tip end side in a standing attitude having the rear end side on the lower side, and then, the pen point member 12 is attached. However, in this case, since a space formed on the tip end side of the filling region 1*x* becomes too large, the piston 7 should be largely advanced in an initial use, which is cumbersome. On the other hand, in the coating instrument 100 according to this embodiment, the appropriate space O can be ensured on the tip end side of the filling region 1*x*.

In the pen-point type coating instrument 100 provided with the pen point member 12 as the coating portion and a brush-type coating instrument provided with a brush bundling fibers as the coating portion, it is difficult to form the space O on the tip end side of the filling region 1*x* due to their structures. In this point, in this embodiment, the space O having the certain amount can be reliably ensured on the tip end side in the filling region 1*x* even in these types of coating instruments (regardless of the type of the coating instrument).

In this embodiment, as described above, the filling jig 50 is used when the coating material M is filled in the filling region 1*x*, and the air is fed into the filling region 1*x* by contracting the volume of the airtight space V in the periphery of the coating instrument 100. As a result, the step of feeding the air into the filling region 1*x* from the discharge outlet 18*a* can be specifically realized.

The discharge outlet 18*a* of this embodiment has, as described above, a predetermined diameter such that the coating material M in a molten state does not flow down from the discharge outlet 18*a*. Thus, the coating material M can be reliably filled in the filling region 1*x*. Moreover, the discharge outlet 18*a* is configured such that the coating material M does not to flow down from the discharge outlet 18*a*. Therefore, such configuration is particularly effective in feeding the air from the discharge outlet 18*a*.

In this embodiment, the hole portions 10*f* and 11*e* as the channel portions leading from the filling region 1*x* to the outside of the filling member 1 in the coating instrument 100 are provided. Thus, as described above, when the piston 7 is assembled to the filling member 1, until a part of the coating material M is made to flow out to the outside of the filling region 1*x* through the hole portions 10*f* and 11*e*, the piston 7 is inserted into and attached to the filling member 1 while the air A between the coating material M and the piston 7 is reliably discharged to the outside of the filling region 1*x* through the hole portions 10*f* and 11*e*. Therefore, interposition of the air A between the coating material M and the piston 7 can be suppressed more reliably.

As a result, marked rising of an internal pressure of the filling region 1*x* due to a temperature change and the like can be suppressed. Natural leakage of the coating material M from the discharge outlet 18*a* can be further prevented. Along with that, when the coating material M is extruded, a state in which the air A works as a cushion and generates time lag can be suppressed. Moreover, the coating material M flowing out of the hole portions 10*f* and 11*e* can be allowed to function as a lubricant for a sliding portion such as the screwing portion 9 and the like in the coating instrument 100 by using its oil component. Moreover, since the excess coating material M is discharged from the hole portions 10*f* and lie, variation in a filled amount of the coating material M can be absorbed. Along with that, variation in a volume of the filling region 1*x* caused by an error in a container dimension or assembling and the like can be absorbed.

When the piston 7 is to be assembled to the filling member 1, in a general filling method in which the air A between the coating material M and the piston 7 is not discharged to the outside of the filling region 1*x*, since there is a distance from the filling opening to the piston 7, particularly if the coating material M with high viscosity is to be filled, air tangles in the vicinity of the piston 7, filling of the coating material M can become difficult. Thus, in this point, too, the working effect by this embodiment is remarkable.

Figure 17B:
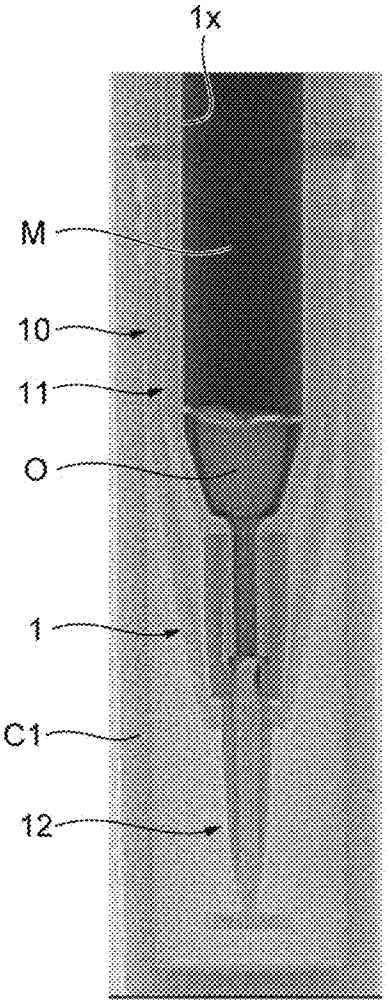
FIG. 17B is an X-ray photo having a position of the coating instrument in FIG. 17A at a position different by 90° around an axis.
Figure 17A:
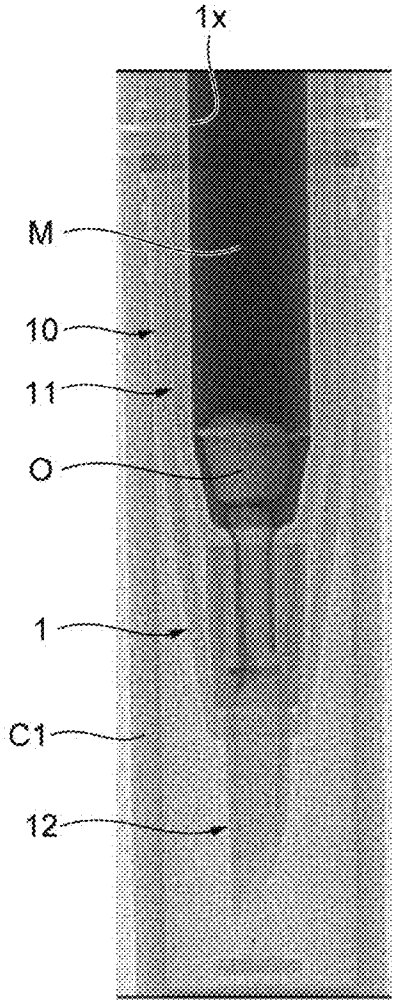
FIG. 17A is an X-ray photo illustrating a state after the coating material is filled in the coating instrument in FIG. 1.

FIGS. 17 are X-ray photos illustrating a state after the coating material is filled by the coating instrument in FIG. 1. As illustrated in FIGS. 17, it can be confirmed that the coating instrument 100 manufactured by this embodiment has the space O having the certain amount reliably ensured on the tip end side in the filling region 1*x* in which the coating material M is filled in the initial state.

Figure 18:
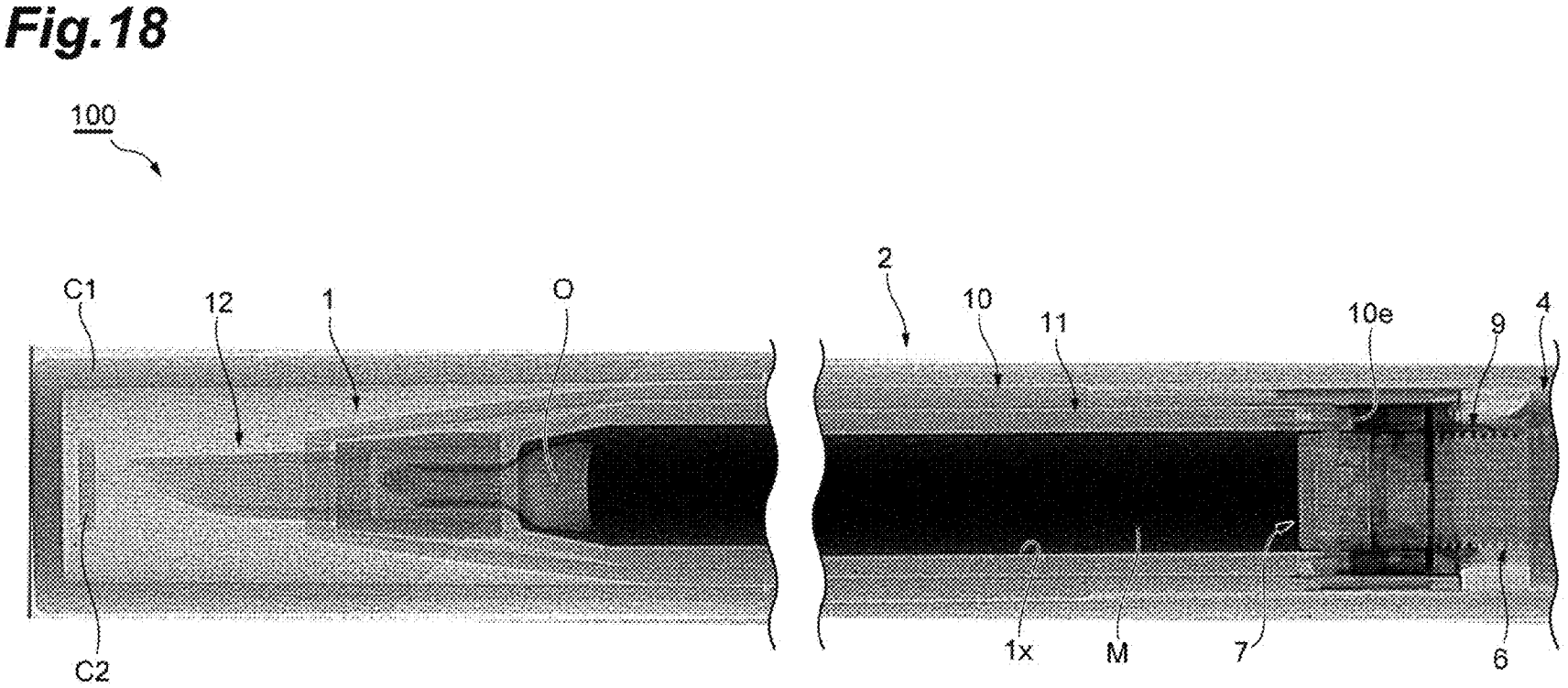
FIG. 18 is an X-ray photo illustrating a part of the coating instrument in FIG. 1.

FIG. 18 is an X-ray photo illustrating a part of the coating instrument in FIG. 1. As illustrated in FIG. 18, in the coating instrument 100 manufactured by this embodiment, in the initial state in which the piston 7 is located at the retreat limit, a part of the coating material M flows out from the hole portion 11*e* to the outside of the filling region 1*x* and thus, reaches the screwing portion 9. As a result, it can be confirmed that interposition of the air A between the coating material M and the piston 7 can be reliably suppressed.

In this embodiment, the following working effects are also exerted.

That is, in this embodiment, as described above, the opening $\mathbf{11}_{out}$ of the hole portion 11*e* is covered by the wall portion 10*x*. It is configured such that the coating material M flowing out of the hole portion 11*e* is guided to the rear. Moreover, the opening $\mathbf{10}_{out}$ of the hole portion 10*f* is covered by the wall portion 2*x*. It is configured such that the coating material M flowing out of the hole portion 10*f* is guided to the rear. Thus, the working effect to have the coating material M function as a lubricant for the sliding portion in the coating instrument 100 can be exerted positively and effectively.

As described above, at least a part of the piston 7 located at the retreat limit is arranged on the front with respect to the rear end $E_R$ of the opening $\mathbf{11}_{in}$ inside the hole portion 11*e*. Thus, when the piston 7 is to be assembled to the filling member 1, the air A between the coating material M and the piston 7 can be discharged to the outside of the filling region 1*x* through the hole portion 11*e* more reliably.

As described above, in a state in which the piston 7 is located at the retreat limit, the protruding portion 7*c* of the piston 7 is arranged on the front beyond the opening $\mathbf{11}_{in}$ in the hole portion 11*e*. Thus, airtightness of the filling region 1*x* can be reliably ensured. Such effect is particularly effective if the coating material M has volatility as in this embodiment since the volatility of the coating material M can be suppressed.

As described above, the front end surface of the piston 7 is made a planar shape. As a result, when the air A between the piston 7 and the coating material M is to be extruded by the piston 7 from the hole portion 11*e*, the air A and the coating material M can be made to flow smoothly (obstruction of the flowing caused by the shape of the piston 7 is suppressed). Interposition of the air A between the coating material M and the piston 7 can be suppressed further reliably.

In this embodiment, the hole portion 11*e* is formed having a lengthy shape in the axial direction. Thus, if the coating material M is to be filled to the middle of the opening I $l_{in}$ in the hole portion 11*e* in the inner filling cylinder 11, an allowable range of its filling amount can be increased, and the coating material M can be easily poured. That is, even in the case of variation in the filling amount of the coating material M, the coating material M can be reliably filled to the middle of the opening $\mathbf{11}_{in}$ in the hole portion 11*e*.

The coating material M as in this embodiment is filled in a jar type glass container and used by a cosmetic brush in general. However, in this case, with a wide-mouth jar type container, there are problems that volatilization of the coating material M is fast and the coating material M can change easily, and a point of the brush is solidified and becomes hard to be used, for example. In this point, in this embodiment, the coating material M can be sealed and protected in double or triple layers by a resin material having fewer open portions and high barrier performances. Thus, this embodiment is advantageous in using the coating material M containing a large amount of a volatile component.

Here, in the coating instrument 100 in the initial state configured as above and illustrated in FIG. 1, the cap C1 and the plug C2 are removed by the user, and the body cylinder 2 and the operation cylinder 3 are relatively rotated in one direction which is a feeding-out direction. In this case, by collaboration between the screwing portion 9 composed of the female screw 4*e* of the screw cylinder 4 and the male screw 6*b* of the moving body 6 and the retaining portion composed of the projection 3*d* of the operation cylinder 3 and the projection 6*c* of the moving body 6, the moving body 6 and the piston 7 advance, and the coating material M filled in the filling region 1*x* of the filling member 1 is discharged from the discharge outlet 18*a* of the pen point member 12 (see FIG. 2).

When the body cylinder 2 and the operation cylinder 3 are relatively rotated as above in one direction, the ratchet teeth 8*b* are urged to the front side in the axial direction by the elastic force of the spring portion 5*b* of the ratchet member 5. As a result, engagement and disengagement (meshing and releasing) of the ratchet teeth 8*a* and 8*b* in the ratchet mechanism 8 are repeated. That is, the side surfaces 8*a*1 of the ratchet teeth 8*a* (see FIG. 7) are engaged with the side surface 8*b*1 of the ratchet teeth 8*b* (see FIG. 9) in the rotating direction, and the ratchet teeth 8*a* slide as if riding up the side surfaces 8*b*1 of the ratchet teeth 8*b*. Then, after the ratchet teeth 8*a* ride over the ratchet teeth 8*b* and engagement is released, the side surface 8*a*1 is engaged with the side surface 8*b*1 in the rotating direction again. As a result, at every engagement and disengagement between the ratchet teeth 8*a* and 8*b*, a click feeling is given to the user. Here, the click feeling is generated once when the body cylinder 2 and the operation cylinder 3 make ⅛ relative rotation (45°) in one direction.

On the other hand, even if the body cylinder 2 and the operation cylinder 3 are to be relatively rotated in the other direction which is the feeding-back direction, the side surfaces 8*a*2 of the ratchet teeth 8*a* (see FIG. 7) are brought into contact with the side surfaces 8*b*2 of the ratchet teeth 8*b* (see FIG. 9) and locked in the rotating direction. As a result, their relative rotation is regulated so that the screw cylinder 4 and the ratchet member 5 are not relatively rotated. As a result, the body cylinder 2 and the operation cylinder 3 are not to be relatively rotated in the other direction.

Moreover, as illustrated in FIGS. 6 and 7, the coating instrument 100 is provided with the above described cam mechanism 20. The cam mechanism 20 advances the moving body 6 and the piston 7 for a certain stroke and then, retreats them for the certain stroke by the relative rotation with a certain rotation amount of the body cylinder 2 and the operation cylinder 3 in one direction. Here, at every ⅛ relative rotation of the body cylinder 2 and the operation cylinder 3 (at every click feeling), the moving body 6 and the piston 7 are advanced/retreated by 1.2 mm. This cam mechanism 20 is provided with the projecting portion 20*a* and the guide portion 20*b* constituted by the raised portion 20*c* and the guide piece 20*d* as described above. The projecting portion 20*a* is relatively guided by the guide portion 20*b*, and the projecting portion 20*a* is relatively moved along a relative trajectory along a sinuous curve.

This cam mechanism 20 converts the rotary force of the relative rotation to the linear force along the axial direction each time when the body cylinder 2 and the operation cylinder 3 are relatively rotated by the certain rotation amount and advances/retreats the moving body 6 and the piston 7 for the certain stroke. Specifically, if the body cylinder 2 and the operation cylinder 3 are relatively rotated in one direction, first, the projecting portion 20*a* is relatively moved to one side in the circumferential direction. Subsequently, a rear side sliding surface 20*a*2 of the projecting portion 20*a* is brought into contact with a guide surface 20*f* of the guide piece 20*d* and slides. As a result, since the guide piece 20*d* (screw cylinder 4) is movable with respect to the body cylinder 2 in the axial direction and is engaged in the rotating direction, the guide piece 20*d* is pushed rearward by the projecting portion 20*a*, and the guide piece 20*d* retreats. Therefore, the screw cylinder 4 retreats, and the moving body 6 screwed with the screw cylinder 4 in the screwing portion 9 retreats. Hence, the piston 7 retreats. As a result, the filling region 1*x* is expanded, and the internal pressure of the filling region 1*x* is automatically reduced.

If the relative rotation in the one direction continues, the projecting portion 20*a* is relatively moved continuously to the one side in the circumferential direction, and the screw cylinder 4, the moving body 6, and the piston 7 continuously retreat. When the projecting portion 20*a* is relatively moved to a position in contact with an edge portion on the one side in the circumferential direction of the guide surface 20*f*, sliding of the projecting portion 20*a* with the guide surface 20*f* is finished, and the screw cylinder 4, the moving body 6, and the piston 7 reach the rearmost position in the cam mechanism 20. At this time (when the rearmost position of the cam mechanism 20 is reached), the ratchet teeth 8*a* ride over the ratchet teeth 8*b*, the ratchet teeth 8*a* and 8*b* are disengaged and engaged, and the click feeling is generated (see FIG. 1).

Moreover, if the relative rotation is continuously made in the one direction, the projecting portion 20*a* is relatively moved to the one side in the circumferential direction, and a front side sliding surface 20*a*1 of the projecting portion 20*a* is brought into contact with the guide surface 20*e* of the raised portion 20*c* and slides. As a result, the raised portion 20*c* is pushed forward by the projecting portion 20*a*, and the raised portion 20*c* advances. Therefore, the screw cylinder 4 advances, and the moving body 6 and the piston 7 advance. As a result, the filling region 1*x* is contracted, and the coating material M in the filling region 1*x* is extruded and discharged from the discharge outlet 18*a*.

If the relative rotation is further made continuously in the one direction, the projecting portion 20*a* is further relatively moved to the one side in the circumferential direction continuously, and the screw cylinder 4, the moving body 6, and the piston 7 continuously advance. When the projecting portion 20*a* is relatively moved to the position in contact with an edge portion on the one side in the circumferential direction of the guide surface 20*e*, sliding of the projecting portion 20*a* with the guide surface 20*e* is finished, and the screw cylinder 4, the moving body 6, and the piston 7 reach the frontmost position in the cam mechanism 20. As a result, the moving body 6 and the piston 7 are advanced/retreated for the certain stroke.

Therefore, in the coating instrument 100 of this embodiment, the following working effect is further exerted. That is, by relatively rotating the body cylinder 2 and the operation cylinder 3 in the one direction by the certain rotation amount and by advancing/retreating the moving body 6 and the piston 7 by the cam mechanism 20 for the certain stroke, not only that the coating material M is discharged but also that the inside of the filling region 1*x* can be automatically decompressed. Since the inside of the filling region 1*x* can be automatically decompressed, leakage of the coating material M, that is, dripping down of the coating material M from the discharge outlet 18*a* as time elapses, for example, can be suppressed easily and reliably. Moreover, a change in the coating material M by the pressure can be suppressed.

Particularly in the coating instrument 100, as described above, the cam mechanism 20 can advance/retreat the moving body 6 and the piston 7 only by the rotary force of the relative rotation not depending on the urging force of the elastic body such as a spring. The urging force of the elastic body might be insufficient for a force required for advancing/retreating the moving body 6 and the piston 7. Thus, according to this embodiment as above, leakage of the coating material M can be suppressed more reliably. Moreover, since the piston 7 defining the filling region 1*x* can be advanced/retreated by the cam mechanism 20, the filling region 1*x* can be directly decompressed.

In the coating instrument 100, as described above, each time the click feeling is generated by the relative rotation of the body cylinder 2 and the operation cylinder 3, the moving body 6 and the piston 7 are advanced/retreated only for the certain stroke. Thus, by the click feeling, the user can sense not only a degree of the relative rotation or a degree of discharge of the coating material M but also the advance/retreat of the moving body 6 and the piston 7 for the certain stroke.

In the coating instrument 100, as described above, the relative rotation of the body cylinder 2 and the operation cylinder 3 in the other direction can be regulated, while only the relative rotation of the body cylinder 2 and the operation cylinder 3 in the one direction can be allowed.

In the coating instrument 100, as described above, when the click feeling is generated, the screw cylinder 4 is located at the rearmost position of the cam mechanism 20, and the inside of the filling region 1*x* is decompressed to the maximum. Thus, in usual times, the user stops the relative rotation (finishes the use) on the basis of the click feeling, and the coating instrument 100 after the use can be easily brought into a state in which the inside of the filling region 1*x* is decompressed. In this point, from actual circumstances that the coating material M can leak particularly easily from the discharge outlet 18*a* during storage after the use, this embodiment which can decompress the inside of the filling region 1*x* of the coating instrument 100 after use to the maximum can be useful.

In the coating instrument 100, the inner filling cylinder 11 may be made transparent, and a window may be formed on a part of the outer filling cylinder 10 (a position where the piston 7 can be visually checked when the piston 7 is located at the position indicated in FIG. 2 which is the advance limit of the moving body 6). In this case, by removing the cap C1 at sales or in use, a color tone or presence of the filled coating material M can be checked. For example, by forming the piston 7 in white, if the coating material M is extruded to the end, and the piston 7 reaches the position of the window formed in the outer filling cylinder 10, the color visually checked through this window is changed from the color of the coating material M to white. Thus, the fact that there is no remaining amount can be recognized, which makes a sign of end of use. Moreover, by using a color different from the color of the coating material M for the pen point 13, a use condition of the coating material M can be visually checked easily.

The embodiment according to the one aspect of the present invention has been described, but the present invention is not limited to the above described embodiment but may be modified within a range not changing the gist described in each claim or may be applied to the others.

For example, in the above described embodiment, the discharge outlet 18*a* has the predetermined diameter such that the coating material M in the molten state does not flow down from the discharge outlet 18*a*, but the tip end side (outlet side) of the filling region 1*x* (filling member 1) may be narrowed so as to have a predetermined diameter. For example, the front end portion 11*d* of the inner filling cylinder 11 may have a cylinder hole with a predetermined diameter. In this case, since it is no longer necessary that the discharge outlet 18*a* has the predetermined diameter, the discharge outlet 18*a* can be made to have a usable shape.

Moreover, in the above described embodiment, by contracting the volume of the airtight space V in the piston 52, the air is fed into the filling region 1*x* through the discharge outlet 18*a*, but this is not limiting. For example, the air can be fed into the filling region 1*x* through the discharge outlet 18*a* by supplying compressed air (pressurized air) from the outside into the airtight space V.

In the above described embodiment, for convenience of explanation, the example in which one unit of the coating instrument 100 is manufactured is illustrated, but a plurality of the coating instruments 100 may be manufactured in parallel at the same time. In this case, the filling jig 50 is provided with the cylinder 51 having a plurality of the recess portions 51*a* formed and a plurality of pistons 52 slidably inserted into each of the recess portions 51*a*.

In the above described embodiment, a pair of hole portions 11*e* each having an oval shape are provided as channel portions, but the channel portion may have a circular (perfect circle) shape or a polygonal shape. Moreover, the number of the channel portions to be provided may be one or three or more. Moreover, the channel portion is not limited to a hole portion penetrating the peripheral wall of the inner filling cylinder 11 but may be a groove portion (recess portion) formed on the inner peripheral surface of the inner filling cylinder 11 and extended to be opened in the rear end surface of the inner filling cylinder 11. In this case, a bottom surface of the groove portion can exert the function performed by the wall portion 10*x* (that is, the function of guiding the coating material M to the rear side). Moreover, the channel portion may be configured to include the hole portion and the groove portion.

In the above described embodiment, in a state in which the space O is formed in the filling region 1*x*, the coating material M is filled to the middle of the opening $\mathbf{11}_{in}$ of the hole portion 11*e* in the inner filling cylinder 11, but the coating material M may be filled to the rear beyond the opening $\mathbf{11}_{in}$ of the hole portion 11*e* in the inner filling cylinder 11. Moreover, the coating material M may be filled to the front not reaching the opening $\mathbf{11}_{in}$.

In the above described embodiment, a rotary type using the screwing portion 9 is employed as the extrusion mechanism, but this is not limiting, and a mechanical extrusion mechanism such as a knocking type or an extrusion mechanism of a squeezing type can be also employed, for example. Moreover, instead of extrusion of the coating material M by advancing the moving body 6 and the piston 7 or in addition to that, there may be a case in which the coating material M is pulled back (retreated) by retreating the moving body 6 and the piston 7.

Moreover, in the above described embodiment, the piston 7 having the flat planar front end surface is used as the extruding portion, but a bell-shaped piston which is tapered toward the front may be also used, and various extruding portions can be used. Moreover, in the above described embodiment, a cylindrical cam mechanism is employed as the cam mechanism 20, but it is needless to say that other types of cam mechanisms can be also employed.

The above described male screw and female screw are not limited to a thread ridge and a thread groove and may be an intermittently disposed projection group or a projection group disposed spirally and intermittently and acting similarly to the threat ridge and the thread groove. Moreover, in the above described embodiment, the spring portion 5*b* is provided integrally with the ratchet member 5, but this spring portion 5*b* may be provided separately from the ratchet member 5. In the above, the rachet mechanism 8 also works as the click mechanism, and the ratchet teeth 8*a* and 8*b* correspond to a pair of click projections (click teeth). Moreover, regarding the ratchet teeth 8*a* and 8*b* of the above described embodiment, the number of clicks is set so that the click feeling is generated 8 times in one relative rotation of the container front portion and the container rear portion, but in order to have the coating material M discharged more finely, the number of clicks may be increased so that the click feeling can be generated 12 times, 18 times and the like in one relative rotation.

In the above described embodiment, the one aspect of the present invention is described as the method for manufacturing the coating instrument 100, but the one aspect of the present invention may be understood as a method for filling the coating material M in the coating instrument 100 or a method of assembling the coating instrument 100. Moreover, the one aspect of the present invention may be also understood as the coating instrument 100 manufactured by the above described manufacturing method.

According to the one aspect of the present invention, the coating instrument which can reliably prevent leakage of the coating material from the discharge outlet can be provided.

What is claimed is:

1. A method for manufacturing a coating instrument provided with a filling member having a filling region in which a coating material is filled and a body portion including an extruding portion inserted inside so as to be brought into close contact with the filling member and constituting a rear end of the filling region, in which the coating material is discharged from a discharge outlet on a tip end side of the filling member by advance of the extruding portion, the method comprising:

a step of filling the coating material into the filling region of the filling member from behind in a state in which a front side of the filling member is located below the rear side;

a step of feeding a predetermined amount of air from the discharge outlet into the filling region so that a space is formed on the tip end side in the filling region after the coating material is filled; and a step of assembling the body portion to the filling member after the air is fed.

2. The method for manufacturing a coating instrument according to claim 1, wherein in the step of feeding the air, by reducing a volume of an airtight space in a periphery of the coating instrument in a state in which the discharge outlet is located in the airtight space, the air is fed into the filling region.

3. The method for manufacturing a coating instrument according to claim 2, wherein the discharge outlet or the tip end side of the filling region has a predetermined diameter such that the coating material filled in the filling region in a molten state does not flow down from the discharge outlet.

4. The method for manufacturing a coating instrument according to claim 3, wherein the filling member is provided with a channel portion extending so as to lead to an outside of the filling member in the coating instrument from the filling region; and in the step of assembling the body portion, a part of the coating material is allowed to flow out to the outside of the filling region through the channel portion.

5. The method for manufacturing a coating instrument according to claim 2, wherein the filling member is provided with a channel portion extending so as to lead to an outside of the filling member in the coating instrument from the filling region; and in the step of assembling the body portion, a part of the coating material is allowed to flow out to the outside of the filling region through the channel portion.

6. The method for manufacturing a coating instrument according to claim 1, wherein the discharge outlet or the tip end side of the filling region has a predetermined diameter such that the coating material filled in the filling region in a molten state does not flow down from the discharge outlet.

7. The method for manufacturing a coating instrument according to claim 6, wherein the filling member is provided with a channel portion extending so as to lead to an outside of the filling member in the coating instrument from the filling region; and in the step of assembling the body portion, a part of the coating material is allowed to flow out to the outside of the filling region through the channel portion.

8. The method for manufacturing a coating instrument according to claim 1, wherein the filling member is provided with a channel portion extending so as to lead to an outside of the filling member in the coating instrument from the filling region; and in the step of assembling the body portion, a part of the coating material is allowed to flow out to the outside of the filling region through the channel portion.

* * * * *